US012590374B2

(12) United States Patent
Kanjolia et al.

(10) Patent No.: US 12,590,374 B2
(45) Date of Patent: Mar. 31, 2026

(54) SELECTIVE THERMAL ATOMIC LAYER ETCHING

(71) Applicant: Merck Patent GmbH, Darmstadt (DE)

(72) Inventors: Ravindra Kanjolia, North Andover, MA (US); Jean-Sébastien Lehn, Winchester, MA (US); Martin E. McBriarty, San Jose, CA (US); Ronald Pearlstein, Carlsbad, CA (US); Jared Leith McWilliams, Royal Oaks, CA (US); Nguyen Minh Vu, San Jose, CA (US)

(73) Assignee: Versum Materials US, LLC, Tempe, AZ (US)

( * ) Notice: Subject to any disclaimer, the term of this patent is extended or adjusted under 35 U.S.C. 154(b) by 2 days.

(21) Appl. No.: 18/693,555

(22) PCT Filed: Oct. 17, 2022

(86) PCT No.: PCT/EP2022/078797
§ 371 (c)(1),
(2) Date: Mar. 20, 2024

(87) PCT Pub. No.: WO2023/066847
PCT Pub. Date: Apr. 27, 2023

(65) Prior Publication Data

US 2025/0137141 A1 May 1, 2025

Related U.S. Application Data

(60) Provisional application No. 63/257,244, filed on Oct. 19, 2021, provisional application No. 63/366,860, filed on Jun. 23, 2022.

(51) Int. Cl.
*C23F 1/44* (2006.01)
*C23F 1/12* (2006.01)

(52) U.S. Cl.
CPC . *C23F 1/44* (2013.01); *C23F 1/12* (2013.01)

(58) Field of Classification Search
CPC ..... C23F 1/44; C23F 1/12
(Continued)

(56) References Cited

U.S. PATENT DOCUMENTS 9,620,627 B1 * 4/2017 Yeo ..... H10D 62/235
10,662,533 B2 * 5/2020 Blomberg ..... H01L 21/32135
(Continued)

FOREIGN PATENT DOCUMENTS

WO WO-2020203636 A1 * 10/2020 ..... H01L 21/302
WO 2022050099 A1 3/2022
WO 2023066847 A1 4/2023

OTHER PUBLICATIONS

Chen_Jack Kun-Chieh et al_"Directional etch of magnetic and noble metals. II. Organic chemical vapor etch" _ Journal of Vacuum Science & Technology A: Vacuum, Surfaces, and Films_2017- A 35, 05C305.

(Continued)

*Primary Examiner* — Duy Vu N Deo
(74) *Attorney, Agent, or Firm* — Versum Materials US, LLC; William T. Slaven, IV

(57) ABSTRACT

The disclosed and claimed subject matter relates to selective thermal atomic layer etching with a novel series of halogen-free organic acids cycled with an oxidant as a co-reactant to etch metals.

31 Claims, 2 Drawing Sheets

(58) Field of Classification Search
USPC ..... 438/706
See application file for complete search history.

(56) References Cited

U.S. PATENT DOCUMENTS

| | | | | |
|---|---|---|---|---|
| 11,062,914 | B2 | 7/2021 | Niskanen | |
| 2009/0204252 | A1 | 8/2009 | Miyoshi | |
| 2019/0055654 | A1* | 2/2019 | George | C23C 16/403 |
| 2021/0175088 | A1* | 6/2021 | Dezelah | C23F 1/12 |

OTHER PUBLICATIONS

Coffey, Brennan M. et al_"Vacuum ultraviolet enhanced atomic layer etching of ruthenium films", Journal of Vacuum Science, American Institute of Physics, 2 Huntington Quadrangle, Melville, NY 11747, vol. 39, No. 1, Dec. 24, 2020.
Elham Mohimi et al._"Thermal Atomic Layer Etching of Copper by Sequential Steps Involving Oxidation and Exposure to Hexafluoroacetylacetone"_ECS Journal of Solid State Science and Technology_2018_7_9_p. 491-p. 495.
Fangyu Wu et al. "Patterning of Cu Films by a Two-Step Plasma Etching Process at Low Temperature" _J. Electrochem. Soc., 157, H474_2010.
Hess_ECS Transactions, 61 (3) 91-96 (2014).
Jing Zhao et al_"Surface chemistry of thermal dry etching of cobalt thin films using hexafluoroacetylacetone (hfacH)" _Applied Surface Science,_455_ 2018_438-445.
Johnson N. R. and George S. M._"WO3 and W Thermal Atomic Layer Etching Using "Conversion-Fluorination" and "Oxidation-Conversion-Fluorination" Mechanisms" _ACS Applied Materials & Interfaces_2017_9_39_34435-34447.
Jones, A. C.; Hitchman, M. L., Eds._Overview of Chemical Vapour Deposition: Precursors, Processes, and Applications; The Royal Society of Chemistry: Cambridge, 2009; Chapter 1, pp. 1-36.
Mahsa Konh et al_"Molecular mechanisms of atomic layer etching of cobalt with sequential exposure to molecular chlorine and diketones" Journal of Vacuum Science & Technology A_37_2_Mar.-Apr. 2019_021004.
MD Rasadujaman et al._Supercritical carbon dioxide etching of transition metal (Cu, Ni, Co, Fe) thin films_Microelectron. Eng. 153, 5 _2016.
P.A. Tamirisa et al_Plasma etching of copper films at low temperature_Microelectron_84_2007_101-108.
Sang, Xia et al_"Patterning nickel for extreme ultraviolet lithography mask application I. Atomic layer etch processing" _Journal of Vacuum Science_American Institute of Physics_2 Huntington Quadrangle_Melville_NY_11747_vol. 38_No. 4_Jun. 29, 2020.
SM George, AW Ott, JW Klaus_Surface Chemistry for Atomic Layer Growth_J. Phys. Chem., 1996, 100, 13121-13131.
Xie, Wenyi et al_"Thermal atomic layer etching of metallic tungsten via oxidation and etch reaction mechanism using O2 or O3 for oxidation and WCI6 as the chlorinating etchant" _Journal of Vacuum Science_American Institute of Physics_2 Huntington Quadrangle_Melville_NY_11747_vol. 38_No. 2_Jan. 28, 2020.
International Search Report and Written Opinion, PCT/EP2022/078797, dated Feb. 17, 2023.

* cited by examiner

Conventional Art Process

Conventional Art Process

SELECTIVE THERMAL ATOMIC LAYER ETCHING

CROSS-REFERENCE TO RELATED APPLICATIONS

This application is a national stage application, filed under 35 U.S.C. § 371, of International Patent Application No. PCT/EP2022/078797 (filed on 17 Oct. 2022) which claims the benefit of U.S. Provisional Patent Application No. 63/257,244 (filed on 19 Oct. 2021) and U.S. Provisional Patent Application No. 63/366,860 (filed on 23 Jun. 2022) all of which applications is incorporated herein by reference in their entirety.

BACKGROUND

Field

The disclosed and claimed subject matter relates to selective thermal atomic layer etching with a novel series of halogen-free organic acids cycled with an oxidant as a co-reactant to etch metals. Selectivity was shown by thermal etching of copper, cobalt, molybdenum, tungsten in conditions where nickel, platinum, ruthenium, zirconium oxide and $SiO_2$ were not etched.

Related Art

The miniaturization of features in the semiconductor industry is the main factor behind the continuous performance increase of devices. This trend is expected to continue for at least a few more generations of computer chips. Several technical challenges need to be successfully solved for this trend to continue.

Atomic Layer Deposition (ALD) is one technique finding increased application in the semiconductor industry and it currently is the deposition method allowing the best control on the amount of material deposited. In ALD, a layer of atoms is deposited on all surfaces that are exposed to a precursor in the gas phase—this layer is at most as thick as the thickness of one atomic layer. By sequentially exposing the surfaces to two different precursors, a layer of material with the desired thickness will be deposited. The archetypical example of such a process is the deposition of aluminum oxide ($Al_2O_3$) from trimethylaluminum (TMA, $Al(CH_3)_3$) and water ($H_2O$), where methane ($CH_4$) is eliminated from the two reacting species. The coating of thin and narrow vias and other high aspect ratio features has been demonstrated numerous times by ALD in the literature.

Atomic Layer Etching (ALE or ALEt) can be viewed as the layer-by-layer subtraction of material when ALD is the layer-by-layer addition of material. In ALE, a layer of atoms is removed from all surfaces that are exposed to a precursor in the gas phase—this layer is ideally also at most as thick as the thickness of one atomic layer. ALE is performed by sequentially exposing the surfaces to at least two different precursors, a $1^{st}$ precursor that activates a layer of surface atoms and a $2^{nd}$ precursor that promotes the sublimation of this activated layer of atoms; sometimes a $3^{rd}$ precursor is used to regenerate the surface to the condition where the $1^{st}$ precursor will be active.

For example, an early copper etching process was described in which copper was chlorinated using a plasma to generate $CuCl_2$. See, e.g., Tamirisa et al., *Microelectron.,* 84, 1055 (2007); Wu et al., *J. Electrochem. Soc.,* 157, H474 (2010) and Hess D. W., Workshop on Atomic-Layer-Etch and Clean Technology, San Francisco, Ca (2014). The $CuCl_2$ layer was then etched with a hydrogen plasma, which generated volatile $Cu_3Cl_3$. This process could be performed at temperatures as low as 20° C. However, the usefulness of this process for etching copper in small features was limited because of significant profile taper.

Another method involved the etching of tungsten. See, e.g., Johnson N. R. and George S. M., *ACS Applied Materials & Interfaces,* 9, 34435 (2017). In this process, and as illustrated in FIG. 1, tungsten could be etched (between 128° C. and 207° C.) by sequentially exposing a tungsten surface having a native oxide layer to:

(A) A mixture of oxygen and ozone, which oxidizes an additional layer of tungsten into tungsten oxide (surface activation);

(B) Boron trichloride, which reacts with some of the tungsten oxide to generate non-volatile boron oxide and volatile tungsten oxychloride (sublimation of tungsten-containing species; some tungsten oxide is still present below the boron oxide); and (C) Hydrogen fluoride, which react with the boron oxide to generate volatile water vapor, and volatile boron trifluoride (regeneration of fresh tungsten oxide surface).

Another method related to the etching of cobalt. See, e.g., Chen et al., J. Vac. Sci. Technol., A 35, 05C305 (2017). In this method, cobalt etching, at temperatures higher than 80° C., was achieved with an etching rate was as high as 28 Å/cycle and was far from being self-limiting. This process involved the sequential exposure of a cobalt surface to:

(A) An oxygen plasma which oxidizes multiple layers of cobalt into cobalt oxide (surface activation); and (B) Formic acid, which react with the cobalt oxide surface species to generate volatile cobalt formate species (sublimation).

An alternative method was used to etch cobalt and copper thin films by using supercritical $CO_2$ and 1,1,1,5,5,5-hexafluoro-2,4,-pentanedione at 100° C. and 250° C. under high-pressure. See, e.g., Rasadujjaman et al., *Microelectron. Eng.* 153, 5 (2016).

Another reported method involved etching copper at temperatures higher than 275° C. with an etch rate of 0.09 nm/cycle. See, e.g., Mohimi et al., *ECS Journal of Solid State Science and Technology,* 7, P491 (2018). This process involved the sequential exposure of a copper surface to:

(A) oxygen which is a mild oxidizer and oxidizes a layer of copper into copper oxide (surface activation); and (B) an acetylacetone (such as 1,1,1,5,5,5-hexafluoro-2,4,-pentanedione (HFAC), which reacts with the copper oxide surface species to generate volatile copper acetylacetonate species (sublimation).

An alternative method was used to etch copper and cobalt films by cycling alcohols, aldehydes, or esters in one step and an oxidizing gas in another step. See, e.g., International Publication WO 2022050099. In one of these procedures, a cobalt oxide film was etched using tert-butyl alcohol and ozone at 275° C. In another of these procedures, a copper oxide film was etched using tert-butyl alcohol and ozone at 275° C.

Some methods to remove copper residues using organic acids, alcohols, or aldehydes have been described. See, e.g., U.S. Pat. No. 11,062,914. In one of these procedures, formic acid is used to remove a passivation film formed on copper after chemical-mechanical planarization (CMP) using benzotriazole.

Some methods to remove a copper-containing film using adsorption of carboxylic acids, carboxylic anhydrides, esters, alcohols, aldehydes, and ketones followed by raising the temperature of the film have been described. See, e.g., U.S. Patent Application Publication No. 2009/0204252. In one of these procedures, formic acid vapor was dosed to a sample containing a copper oxide film at room temperature. The sample was then heated to 150° C. to desorb an organic complex containing copper derived from the copper oxide film. For processing efficiency and uniformity in semiconductor fabrication, however, it may be desired to maintain a constant substrate temperature.

Several cobalt etching procedures have also been described. See, e.g., Zhao et al., *Applied Surface Science,* 455, 438 (2018) and Konh et al., *Journal of Vacuum Science & Technology A,* 37, 021004 (2019). In one of these procedures, cobalt was etched at temperatures higher than 377° C. and exposing the cobalt surface (with a native oxide) to 1,1,1,5,5,5-hexafluoro-2,4,-pentanedione (HFAC). The treated surface was then heated to produce sublimation of cobalt 1,1,1,5,5,5-hexafluoro-2,4,-pentanedionate. In a variant, illustrated in FIG. 2, cobalt was etched at temperatures higher than 140° C. by sequentially exposing the cobalt surface to:

(A) chlorine which oxidizes a layer of cobalt into cobalt chloride (surface activation); and (B) an acetylacetone (such as 1,1,1,5,5,5-hexafluoro-2,4,-pentanedione (HFAC), which react with the cobalt chloride surface species to generate volatile cobalt chloro-acetylacetonate species (sublimation).

All the processes described above permit etching of metals while either using an oxygen plasma or halogen-containing reactants. However, plasmas can be destructive to substrates and halogens can lead to contamination. Thus, new etching reagents—such as those used in the disclosed and claimed subject matter (including, but not limited to, pivalic acid, isobutyric acid, and/or propionic acid as volatilizing agents, and water, oxygen, and/or hydrogen peroxide as oxidants)—do not require a plasma and do not contain halogens.

SUMMARY

In one aspect, the disclosed and claimed subject matter relates to a method for the selective thermal atomic layer etching with one or more halogen-free organic acid volatizer together with one or more of water, oxygen and a water/oxygen mixture as an oxidizing co-reactant to etch metals. In one embodiment, the one or more halogen-free organic acid volatilizer includes one or more of propionic acid, isobutyric acid, pivalic acid, acetic acid, butanoic acid, acrylic acid, methacrylic acid, 2-methylbutanoic acid, 3-methylbutanoic acid, 3-butenoic acid, cyclopropanecarboxylic acid, pentanoic acid, (2E)-but-2-enoic acid, (Z)-2-butenoic acid and combinations thereof.

In one aspect, the disclosed and claimed subject matter relates to a method for the selective thermal atomic layer etching with pivalic acid as a volatizer together with one or more of water, oxygen and a water/oxygen mixture as an oxidizing co-reactant to selectively etch copper, cobalt, molybdenum and/or tungsten in conditions where nickel, platinum, ruthenium, zirconium oxide and/or and $SiO_2$ are not etched.

In one aspect, the disclosed and claimed subject matter relates to a method for the selective thermal atomic layer etching with isobutyric acid as a volatizer together with one or more of water, oxygen and a water/oxygen mixture as an oxidizing co-reactant to selectively etch copper, cobalt, molybdenum and/or tungsten.

In one aspect, the disclosed and claimed subject matter relates to a method for the selective thermal atomic layer etching with propionic acid as a volatizer together with one or more of water, oxygen and a water/oxygen mixture as an oxidizing co-reactant to selectively etch copper, cobalt, molybdenum, and/or tungsten.

In one aspect, the disclosed and claimed subject matter relates to a method for the selective thermal atomic layer etching with one or more of pivalic acid, isobutyric acid and propionic acid, each of which is halogen-free, as a volatizer together with one or more of water, oxygen and a water/oxygen mixture as an oxidizing co-reactant. In this manner, the disclosed and claimed process avoids all risk of contaminating the substrates with halogen atoms. In one aspect of this embodiment, there is no reactant that includes iodine. In one aspect of this embodiment, there is no reactant that includes bromine. In one aspect of this embodiment, there is no reactant that includes chlorine. In one aspect of this embodiment, there is no reactant that includes fluorine. In one aspect of this embodiment, the method is free of 1,1,1,5,5,5-hexafluoro-2,4,-pentanedione (HFAC) and similar materials.

In one aspect, the disclosed and claimed subject matter relates to a method for the selective thermal atomic layer etching with one or more of pivalic acid, isobutyric acid and propionic acid as a volatizer together with one or more of water, oxygen and a water/oxygen mixture as an oxidizing co-reactant that does not include or does not necessarily require the use of plasma.

In one aspect, the disclosed and claimed subject matter relates to a method for the selective thermal atomic layer etching with one or more of pivalic acid, isobutyric acid and propionic acid as a volatizer together with water as an oxidizing co-reactant and that further includes employs strong oxidizers (e.g., ozone, hydrogen peroxide, nitrous oxide, and oxygen). In this regard, the water co-reactant functions as a mild oxidizer.

In one aspect, the disclosed and claimed subject matter relates to a method for the selective thermal atomic layer etching with one or more of pivalic acid, isobutyric acid and propionic acid as a volatizer together with hydrogen peroxide as an oxidizing co-reactant.

In one aspect, the disclosed and claimed subject matter relates to a method for the selective thermal atomic layer etching with one or more of pivalic acid, isobutyric acid and propionic acid as a volatizer together with a plasma containing oxygen as an oxidizing co-reactant.

In one aspect, the disclosed and claimed subject matter relates to a method for the selective thermal atomic layer etching with one or more of pivalic acid, isobutyric acid and propionic acid as a volatizer together with water, oxygen and a water/oxygen mixture as an oxidizing co-reactant that can be performed at low temperatures. In one aspect of this embodiment, etching can proceed at temperatures as low as 110° C. depending on the metal to be etched. In one aspect of this embodiment, etching of copper can proceed at temperatures between about 110° C. to about 300° C. In one aspect of this embodiment, cobalt etching is slower at about 300° C. and faster at about 335° C. In one aspect of this embodiment, tungsten etching proceeds slowly at about 335° C. In one aspect of this embodiment, molybdenum etching proceeds slowly at about 335° C.

This summary section does not specify every embodiment and/or incrementally novel aspect of the disclosed and claimed subject matter. Instead, this summary only provides a preliminary discussion of different embodiments and corresponding points of novelty over conventional techniques and the known art. For additional details and/or possible perspectives of the disclosed and claimed subject matter and embodiments, the reader is directed to the Detailed Description section and corresponding figures of the disclosure as further discussed below.

The order of discussion of the different steps described herein has been presented for clarity's sake. In general, the steps disclosed herein can be performed in any suitable order. Additionally, although each of the different features, techniques, configurations, etc. disclosed herein may be discussed in different places of this disclosure, it is intended that each of the concepts can be executed independently of each other or in combination with each other as appropriate. Accordingly, the disclosed and claimed subject matter can be embodied and viewed in many different ways.

BRIEF DESCRIPTION OF THE DRAWINGS

The accompanying drawings, which are included to provide a further understanding of the disclosed subject matter and are incorporated in and constitute a part of this specification, illustrate embodiments of the disclosed subject matter and together with the description serve to explain the principles of the disclosed subject matter. In the drawings.

DEFINITIONS

Figure 1:
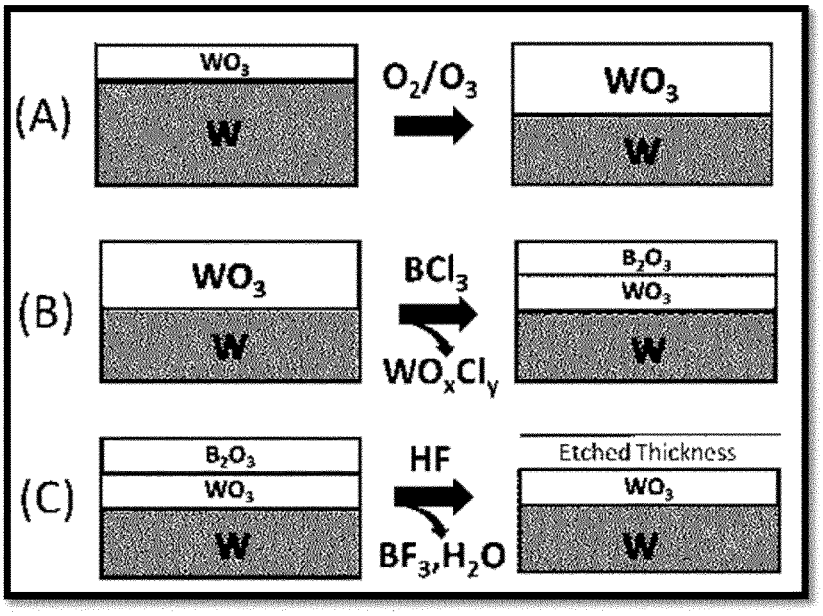
FIG. 1 illustrates a conventional art etching process.
Figure 2:
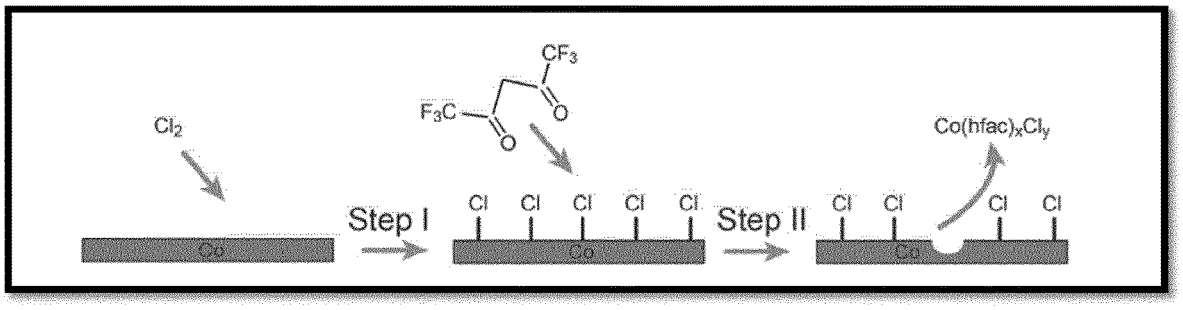
FIG. 2 illustrates a conventional art etching process.

Unless otherwise stated, the following terms used in the specification and claims shall have the following meanings for this application.

For purposes of the disclosed and claimed subject matter, the numbering scheme for the Periodic Table Groups is according to the IUPAC Periodic Table of Elements.

The term "and/or" as used in a phrase such as "A and/or B" herein is intended to include "A and B," "A or B," "A" and "B."

The terms "substituent," "radical," "group" and "moiety" may be used interchangeably.

As used herein, the terms "metal-containing complex" (or more simply, "complex") and "precursor" are used interchangeably and refer to metal-containing molecule or compound which can be used to prepare a metal-containing film by a vapor deposition process such as, for example, ALD or CVD. The metal-containing complex may be deposited on, adsorbed to, decomposed on, delivered to, and/or passed over a substrate or surface thereof, as to form a metal-containing film.

As used herein, the term "metal-containing film" includes not only an elemental metal film as more fully defined below, but also a film which includes a metal along with one or more elements, for example a metal oxide film, metal nitride film, metal silicide film, a metal carbide film and the like. As used herein, the terms "elemental metal film" and "pure metal film" are used interchangeably and refer to a film which consists of, or consists essentially of, pure metal. For example, the elemental metal film may include 100% pure metal or the elemental metal film may include at least about 70%, at least about 80%, at least about 90%, at least about 95%, at least about 96%, at least about 97%, at least about 98%, at least about 99%, at least about 99.9%, or at least about 99.99% pure metal along with one or more impurities. Unless context dictates otherwise, the term "metal film" shall be interpreted to mean an elemental metal film.

As used herein, the term "vapor deposition process" is used to refer to any type of vapor deposition technique, including but not limited to, CVD and ALD. In various embodiments, CVD may take the form of conventional (i.e., continuous flow) CVD, liquid injection CVD, or photo-assisted CVD. CVD may also take the form of a pulsed technique, i.e., pulsed CVD. ALD is used to form a metal-containing film by vaporizing and/or passing at least one metal complex disclosed herein over a substrate surface. For conventional ALD processes see, for example, George S. M., et al. *J. Phys. Chem.,* 1996, 100, 13121-13131. In other embodiments, ALD may take the form of conventional (i.e., pulsed injection) ALD, liquid injection ALD, photo-assisted ALD, plasma-assisted ALD, or plasma-enhanced ALD. The term "vapor deposition process" further includes various vapor deposition techniques described in *Chemical Vapour Deposition: Precursors, Processes, and Applications*; Jones, A. C.; Hitchman, M. L., Eds., The Royal Society of Chemistry: Cambridge, 2009; Chapter 1, pp. 1-36.

As used herein, the term "feature" refers to an opening in a substrate which may be defined by one or more sidewalls, a bottom surface, and upper corners. In various aspects, the feature may be a via, a trench, contact, dual damascene, etc.

The term "about" or "approximately," when used in connection with a measurable numerical variable, refers to the indicated value of the variable and to all values of the variable that are within the experimental error of the indicated value (e.g., within the 95% confidence limit for the mean) or within percentage of the indicated value (e.g., +10%, +5%), whichever is greater.

The materials used in the disclosed and claimed processes are preferably substantially free of water. As used herein, the term "substantially free" as it relates to water, means less than 5000 ppm (by weight) measured by proton NMR or Karl Fischer titration, preferably less than 3000 ppm measured by proton NMR or Karl Fischer titration, and more preferably less than 1000 ppm measured by proton NMR or Karl Fischer titration, and most preferably less than 100 ppm measured by proton NMR or Karl Fischer titration.

The materials used in the disclosed and claimed processes are also preferably substantially free of metal ions or metals such as, $Li^+$ (Li), $Na^+$ (Na), $K^+$ (K), $Mg^{2+}$ (Mg), $Ca^{2+}$ (Ca), $Al^{3+}$(Al), $Fe^{2+}$ (Fe), $Fe^{3+}$ (Fe), $Ni^{2+}$ (Ni), $Cr^+$ (Cr), titanium (Ti), vanadium (V), manganese (Mn), cobalt (Co), nickel (Ni), copper (Cu) or zinc (Zn). These metal ions or metals are potentially present from the starting materials/reactor employed to synthesize the precursors. As used herein, the term "substantially free" as it relates to Li, Na, K, Mg, Ca, Al, Fe, Ni, Cr, Ti, V, Mn, Co, Ni, Cu or Zn means less than 5 ppm (by weight), preferably less than 3 ppm, and more preferably less than 1 ppm, and most preferably 0.1 ppm as measured by ICP-MS (inductively coupled plasma mass spectrometry).

Unless otherwise indicated, "alkyl" refers to $C_1$ to $C_{20}$ hydrocarbon groups which can be linear, branched (e.g., methyl, ethyl, propyl, isopropyl, tert-butyl and the like) or cyclic (e.g., cyclohexyl, cyclopropyl, cyclopentyl and the like). These alkyl moieties may be substituted or unsubstituted as described below. The term "alkyl" refers to such moieties with $C_1$ to $C_{20}$ carbons. It is understood that for structural reasons linear alkyls start with $C_1$, while branched alkyls and cyclic alkyls start with $C_3$. Moreover, it is further understood that moieties derived from alkyls described below, such as alkyloxy and perfluoroalkyl, have the same carbon number ranges unless otherwise indicated. If the length of the alkyl group is specified as other than described above, the above-described definition of alkyl still stands with respect to it encompassing all types of alkyl moieties as described above and that the structural consideration with regards to minimum number of carbons for a given type of alkyl group still apply.

Halo or halide refers to a halogen, F, Cl, Br or I which is linked by one bond to an organic moiety. In some embodiments, the halogen is F. In other embodiments, the halogen is Cl.

Halogenated alkyl refers to a $C_1$ to $C_{20}$ alkyl which is fully or partially halogenated.

Perfluoroalkyl refers to a linear, cyclic or branched saturated alkyl group as defined above in which the hydrogens have all been replaced by fluorine (e.g., trifluoromethyl, perfluoroethyl, perfluoropropyl, perfluorobutyl, perfluoroisopropyl, perfluorocyclohexyl and the like).

The materials used in the disclosed and claimed processes are preferably substantially free of organic impurities which are from either starting materials employed during synthesis or by-products generated during synthesis. Examples include, but not limited to, alkanes, alkenes, alkynes, dienes, ethers, esters, acetates, amines, ketones, amides, aromatic compounds. As used herein, the term "free of" organic impurities, means 1000 ppm or less as measured by GC, (gas chromatography) preferably 500 ppm or less (by weight) as measured by GC, most preferably 100 ppm or less (by weight) as measured by GC or other analytical method for assay. Importantly the precursors preferably have purity of 98 wt. % or higher, more preferably 99 wt. % or higher as measured by GC when used as precursor to deposit the ruthenium-containing films.

The section headings used herein are for organizational purposes and are not to be construed as limiting the subject matter described. All documents, or portions of documents, cited in this application, including, but not limited to, patents, patent applications, articles, books, and treatises, are hereby expressly incorporated herein by reference in their entirety for any purpose. In the event that any of the incorporated literature and similar materials defines a term in a manner that contradicts the definition of that term in this application, this application controls.

DETAILED DESCRIPTION

It is to be understood that both the foregoing general description and the following detailed description are illustrative and explanatory, and are not restrictive of the subject matter, as claimed. The objects, features, advantages and ideas of the disclosed subject matter will be apparent to those skilled in the art from the description provided in the specification, and the disclosed subject matter will be readily practicable by those skilled in the art on the basis of the description appearing herein. The description of any "preferred embodiments" and/or the examples which show preferred modes for practicing the disclosed subject matter are included for the purpose of explanation and are not intended to limit the scope of the claims.

It will also be apparent to those skilled in the art that various modifications may be made in how the disclosed subject matter is practiced based on described aspects in the specification without departing from the spirit and scope of the disclosed subject matter disclosed herein.

In one embodiment, the disclosed and claimed subject matter relates to processes for the isotropic thermal ALE of metals, including copper, cobalt, molybdenum, and/or tungsten. The processes include, consist essentially of or consist of the steps of:

(i) an oxidation that includes exposing the surface of the metal to one or more oxidizing and/or hydroxylating co-reactant (or "oxidizer" or "surface modifier") to produce an oxidized and/or hydroxylated surface;

(ii) a first purge;

(iii) a volatilization that includes exposing the oxidized and/or hydroxylated surface to one or more volatilizing agents (or "volatizers") to produce a volatile metal-organic species; and (iv) a second purge.

In a further aspect of this embodiment, the method consists essentially of steps (i), (ii), (iii) and (iv). In a further aspect of this embodiment, the method consists of steps (i), (ii), (iii) and (iv). The steps in the processes can be cycled as many times as needed to remove a desired thickness of metal oxide. In a further aspect, any of the forgoing embodiments can further include, consist essentially of or consist of a step (v) post-treatment may be added to remove impurities remaining on the surface following a desired number of cycles.

As noted above, the disclosed and claimed subject matter relates to a method for the selective thermal atomic layer etching that includes etching cycles that include, consist essentially of or consist of exposing a metal surface to one or more halogen-free organic acid and one or more an oxidizing co-reactant in cycles. A single cycle of the disclosed and claimed method includes, consists essentially of or consists of:

$$(\text{Step 1})_n+(\text{Step 2})_m$$

where: n and m each independently=1-20 and represent the number of times (i.e., the number of iterations) that Step 1 and Step 2 are each performed within a single cycle;

Step 1 includes sequentially exposing a metal surface to one or more oxidizing co-reactant (Step 1A) and purging with an inert gas (Step 1B); and Step 2 includes sequentially exposing a metal surface to one or more halogen-free organic acid (Step 2A) and purging with an inert gas (Step 2B).

Thus, it is to be understood that n also equals the number of times steps 1A and 1B are sequentially performed within in Step 1 and m also equals the number of times steps 2A and 2B are sequentially performed within Step 2.

In particular, the disclosed and claimed subject matter relates to a thermal atomic layer etching (ALE) process performed in a reactor for selectively etching a metal substrate including the steps of:

Step 1 including sequentially performing:

Step 1A including exposing a metal surface to an oxidizing vapor including one or more of water vapor, oxygen, ozone, nitrous oxide, hydrogen peroxide, oxygen plasma, and combinations thereof, and Step 1B including purging the oxidizing vapor with an inert gas; and Step 2 including sequentially performing:

Step 2A including exposing the metal surface to one or more halogen-free organic acid volatizer, and Step 2B including purging the one or more halogen-free organic acid volatizer with an inert gas;

wherein one cycle of the process is determined by the formula $(\text{Step 1})_n+(\text{Step 2})_m$, wherein n and m are each independently=1-20.

In one embodiment, each iteration of Step 1 alternates with an iteration of Step 2 within each cycle. In another embodiment, all iterations of Step 1 are begun and completed before the iterations of Step 2 are begun and completed within in each cycle.

In one embodiment, n is the same as m. In one embodiment, n is different from m.

In one embodiment n=1. In one embodiment n=2. In one embodiment n=3. In one embodiment n=4. In one embodiment n=5. In one embodiment n=6. In one embodiment n=7. In one embodiment n=8. In one embodiment n=9. In one embodiment n=10. In one embodiment n=11. In one embodiment n=12. In one embodiment n=13. In one embodiment n=14. In one embodiment n=15. In one embodiment n=16. In one embodiment n=17. In one embodiment n=18. In one embodiment n=19. In one embodiment n=20.

In one embodiment m=1. In one embodiment m=2. In one embodiment m=3. In one embodiment m=4. In one embodiment m=5. In one embodiment m=6. In one embodiment m=7. In one embodiment m=8. In one embodiment m=9. In one embodiment m=10. In one embodiment m=11. In one embodiment m=12. In one embodiment m=13. In one embodiment m=14. In one embodiment m=15. In one embodiment m=16. In one embodiment m=17. In one embodiment m=18. In one embodiment m=19. In one embodiment m=20.

In one embodiment n=1 and m=1. In one embodiment n=2 and m=2. In one embodiment n=3 and m=3. In one embodiment n=4 and m=4. In one embodiment n=5 and m=5. In one embodiment n=6 and m=6. In one embodiment n=7 and m=7. In one embodiment n=8 and m=8. In one embodiment n=9 and m=9. In one embodiment n=10 and m=10. In one embodiment n=11 and m=11. In one embodiment n=12 and m=12. In one embodiment n=13 and m=13. In one embodiment n=14 and m=14. In one embodiment n=15 and m=15. In one embodiment n=16 and m=16. In one embodiment n=17 and m=17. In one embodiment n=18 and m=18. In one embodiment n=19 and m=19. In one embodiment n=20 and m=20.

Figure 3:
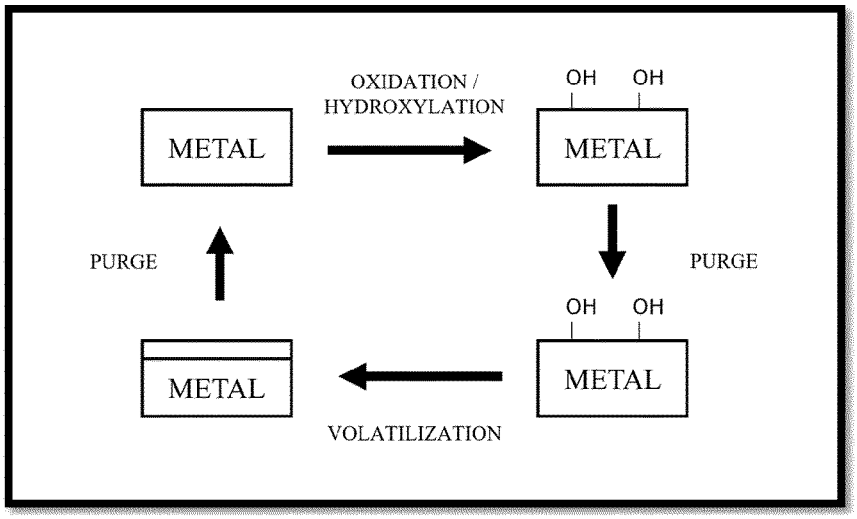
FIG. 3 illustrates an embodiment of the disclosed and claimed selective etching process.

FIG. 3 illustrates an embodiment of the disclosed and claimed selective etching process using water vapor.

Number of Cycles

The disclosed and claimed process can include any number of desired cycles. In one embodiment, the number of cycles is from about 20 to about 5000 cycles. In one embodiment, the number of cycles is from about 20 to about 2200 cycles. In one embodiment, the number of cycles is from about 50 to about 5000. In one embodiment, the number of cycles is from about 50 to about 2500. In one embodiment, the number of cycles is from about 50 to about 1500. In one embodiment, the number of cycles is from about 50 to about 1000. In one embodiment, the number of cycles is from about 50 to about 750. In one embodiment, the number of cycles is from about 50 to about 500. In one embodiment, the number of cycles is from about 50 to about 300. In one embodiment, the number of cycles is from about 50 to about 200. In one embodiment, the number of cycles is from about 150 to about 4000. In one embodiment, the number of cycles is from about 200 to about 3000. In one embodiment, the number of cycles is from about 250 to about 2500. In one embodiment, the number of cycles is from about 350 to about 2000. In one embodiment, the number of cycles is from about 450 to about 1700. In one embodiment, the number of cycles is from about 500 to about 1500. In one embodiment, the number of cycles is from about 750 to about 1250. In one embodiment, the number of cycles is from about 250 to about 1000. In one embodiment, the number of cycles is from about 500 to about 1000. In one embodiment, the number of cycles is from about 750 to about 1000.

In one embodiment, the number of cycles is about 50. In one embodiment, the number of cycles is about 100. In one embodiment, the number of cycles is about 125. In one embodiment, the number of cycles is about 150. In one embodiment, the number of cycles is about 175. In one embodiment, the number of cycles is about 200. In one embodiment, the number of cycles is about 250. In one embodiment, the number of cycles is about 300. In one embodiment, the number of cycles is about 350. In one embodiment, the number of cycles is about 400. In one embodiment, the number of cycles is about 450. In one embodiment, the number of cycles is about 500. In one embodiment, the number of cycles is about 750. In one embodiment, the number of cycles is about 1000. In one embodiment, the number of cycles is about 1250. In one embodiment, the number of cycles is about 1500. In one embodiment, the number of cycles is about 1750. In one embodiment, the number of cycles is about 2000. In one embodiment, the number of cycles is about 2250. In one embodiment, the number of cycles is about 2500. In one embodiment, the number of cycles is about 2750. In one embodiment, the number of cycles is about 3000. In one embodiment, the number of cycles is about 3250. In one embodiment, the number of cycles is about 3500. In one embodiment, the number of cycles is about 4000. In one embodiment, the number of cycles is about 4500. In one embodiment, the number of cycles is about 5000.

Chamber (Reactor) Temperatures

In one embodiment, the reactor includes a reactor chamber that includes a body and a heatable lid, an outer heater and an inner heater (pedestal).

Outer Heater

In one embodiment, the chamber outer heater is set at from about 100° C. to about 400° C. In one embodiment, the chamber outer heater is set at about 140° C. In one embodiment, the chamber outer heater is set at about 160° C. In one embodiment, the chamber outer heater is set at about 200° C. In one embodiment, the chamber outer heater is set at about 225° C. In one embodiment, the chamber outer heater is set at about 250° C. In one embodiment, the chamber outer heater is set at about 280° C. In one embodiment, the chamber outer heater is set at about 300° C. In one embodiment, the chamber outer heater is set at about 325° C. In one embodiment, the chamber outer heater is set at about 350° C. In one embodiment, the chamber outer heater is set at about 375° C. In one embodiment, the chamber outer heater is set at about 400° C. In one embodiment, the reactor chamber includes an outer heater heated to a temperature of about 100° C. to about 300° C. and an inner heater heated to a temperature of about 100° C. to about 350° C.

Lid Heater (i.e., Process Chamber Gas Delivery Zone)

In one embodiment, the chamber lid heater is set from about 100° C. to about 200° C. In one embodiment, the chamber lid heater is set at about 100° C. In one embodiment, the chamber lid heater is set at about 130° C. In one embodiment, the chamber lid heater is set at about 150° C. In one embodiment, the chamber lid heater is set at about 200° C.

Inner Heater (i.e., Process Chamber or Sample Pedestal)

In one embodiment, the chamber inner heater is set at from about 100° C. to about 350° C. In one embodiment, the chamber inner heater is set at about 140° C. In one embodiment, the chamber inner heater is set at about 150° C. In one embodiment, the chamber inner heater is set at about 160° C. In one embodiment, the chamber inner heater is set at about 170° C. In one embodiment, the chamber inner heater is set at about 180° C. In one embodiment, the chamber inner heater is set at about 190° C. In one embodiment, the chamber inner heater is set at about 200° C. In one embodiment, the chamber inner heater is set at about 225° C. In one embodiment, the chamber inner heater is set at about 250° C. In one embodiment, the chamber inner heater is set at about 275° C. In one embodiment, the chamber inner heater is set at about 300° C. In one embodiment, the chamber inner heater is set at about 325° C. In one embodiment, the chamber inner heater is set at about 335° C.

Metals

As noted above, the disclosed and claimed process provides selective thermal etching on certain metal substrates. In one embodiment, the disclosed and claimed process selectively etches a substrate including one or more of copper, cobalt, molybdenum and tungsten preferentially instead of nickel, platinum, ruthenium, zirconium oxide and/or and $SiO_2$. In one embodiment, the disclosed and claimed process selectively etches a substrate including copper. In one embodiment, the disclosed and claimed process selectively etches a substrate including cobalt. In one embodiment, the disclosed and claimed process selectively etches a substrate including molybdenum. In one embodiment, the disclosed and claimed process selectively etches a substrate including tungsten. In one embodiment, the disclosed and claim process does not etch or does not substantially etch a substrate including one or more of nickel, platinum, ruthenium, zirconium oxide and/or $SiO_2$.

Selective Etch Steps

Step 1: Oxidizing Sequence

Step 1 includes, consists essentially of or consists of sequentially exposing a metal surface to one or more oxidizing co-reactant (Step 1A) and purging with an inert gas (step 1B). The one or more oxidizing co-reactant is preferably delivered as a vapor Step 1A: Oxidizing Co-Reactant Exposure In Step 1A, a metal surface is exposed to one or more oxidizing co-reactant. The one or more oxidizing co-reactant is preferably delivered as a vapor (i.e., an "oxidizing vapor"), such as water vapor, water vapor co-flowed with an oxidizer such as oxygen, ozone, nitrous oxide, nitric oxide, or hydrogen peroxide, or an oxidizing vapor composed of oxygen, ozone, nitric oxide, oxygen plasma or hydrogen peroxide without co-flowed water vapor, for a suitable time period and at a temperature sufficient to oxidize the surface of a metal substrate.

In one embodiment, the oxidizing vapor includes one or more of water vapor, oxygen, ozone, nitrous oxide, nitric oxide, hydrogen peroxide, and oxygen plasma and combinations thereof. In one aspect of this embodiment, the oxidizing vapor includes water vapor. In one aspect of this embodiment, the oxidizing vapor includes oxygen. In one aspect of this embodiment, the oxidizing vapor includes ozone. In one aspect of this embodiment, the oxidizing vapor includes nitrous oxide. In one aspect of this embodiment, the oxidizing vapor includes oxygen plasma. In one aspect of this embodiment, the oxidizing vapor includes hydrogen peroxide. In one aspect of this embodiment, the oxidizing vapor includes water vapor and one or more of oxygen, ozone, nitrous oxide, hydrogen peroxide, and oxygen plasma. In one aspect of this embodiment, the oxidizing vapor includes water vapor and oxygen. In one aspect of this embodiment, the oxidizing vapor includes water vapor and ozone. In one aspect of this embodiment, the oxidizing vapor includes water vapor and nitrous oxide. In one aspect of this embodiment, the oxidizing vapor includes water vapor and oxygen plasma. In one aspect of this embodiment, the oxidizing vapor includes water vapor and hydrogen peroxide. In one aspect of this embodiment, the oxidizing vapor includes water vapor and two or more of oxygen, ozone, nitrous oxide hydrogen peroxide.

Time

In one embodiment, the Step 1A oxidizing vapor exposure is from about 0.25 seconds to about 6 seconds. In one embodiment, the Step 1A oxidizing vapor exposure is from about 0.25 seconds to about 2 seconds. In one embodiment, the Step 1A oxidizing vapor exposure is from about 0.5 seconds to about 5 seconds. In one embodiment, the Step 1A oxidizing vapor exposure is from about 5 seconds to about 15 seconds. In one embodiment, the Step 1A oxidizing vapor exposure is about 0.25 seconds. In one embodiment, the Step 1A oxidizing vapor exposure is about 0.5 seconds. In one embodiment, the Step 1A oxidizing vapor exposure is about 1 second. In one embodiment, the Step 1A oxidizing vapor exposure is about 2 seconds. In one embodiment, the Step 1A oxidizing vapor exposure is about 4 seconds. In one embodiment, the Step 1A oxidizing vapor exposure is about 5 seconds. In one embodiment, the Step 1A oxidizing vapor exposure is about 6 seconds. In one embodiment, the Step 1A oxidizing vapor exposure is about 7 seconds. In one embodiment, the Step 1A oxidizing vapor exposure is about 10 seconds. In one embodiment, the Step 1A oxidizing vapor exposure is about 12 seconds. In one embodiment, the Step 1A oxidizing vapor exposure is about 15 seconds.

Temperature (Oxidizing Vapor Source)

In one embodiment, in Step 1A the oxidizing vapor source is not actively heated and is maintained at an ambient temperature of about 20° C. to about 35° C. In one embodiment, in Step 1A the oxidizing vapor source is heated to and held at from about 20° C. to about 30° C. In one embodiment, in Step 1A the oxidizing vapor source is heated to and held at from about 30° C. to about 35° C. In one embodiment, in Step 1A the oxidizing vapor source is heated to and held at about 25° C. In one embodiment, in Step 1A the oxidizing vapor source is heated to and held at about 30° C. In one embodiment, in Step 1A the oxidizing vapor source is heated to and held at about 35° C.

Temperature (Water Vapor Source)

In one embodiment, in Step 1A the water source is chilled to and held at from about 0° C. to about 5° C. In one embodiment, in Step 1A the water source is chilled to and held at from about 5° C. to about 10° C. In one embodiment, in Step 1A the water source is chilled to and held at from about 10° C. to about 15° C. In one embodiment, in Step 1A the water source is chilled to and held at from about 15° C. to about 20° C. In one embodiment, in Step 1A the water source is chilled to and held at from about 20° C. to about 25° C. In one embodiment, in Step 1A the water vapor source is heated to and held at from about 20° C. to about 25° C. In one embodiment, the Step 1A water vapor is heated to and held at from about 25° C. to about 30° C. In one embodiment, the Step 1A water vapor source is heated to and held at from about 30° C. to about 35° C. In one embodiment, in Step 1A the water vapor source is heated to and held at from about 35° C. to about 40° C. In one embodiment, in Step 1A the water vapor source is heated to and held at from about 40° C. to about 45° C.

In one embodiment, in Step 1A the water vapor source is chilled to and held at about 0° C. In one embodiment, in Step 1A the water vapor source is chilled to and held at about 5° C. In one embodiment, in Step 1A the water vapor source is chilled to and held at about 10° C. In one embodiment, in Step 1A the water vapor source is chilled to and held at about 15° C. In one embodiment, in Step 1A the water vapor source is chilled to and held at about 20° C. In one embodiment, in Step 1A the water vapor source is heated to and held at about 20° C. In one embodiment, in Step 1A the water vapor source is heated to and held at about 25° C. In one embodiment, in Step 1A the water vapor source is heated to and held at about 30° C. In one embodiment, in Step 1A the water vapor source is heated to and held at about 40° C. In one embodiment, in Step 1A the water vapor source is heated to and held at about 45° C.

In one embodiment, the water vapor source temperature is held substantially constant. In one embodiment, the water vapor source temperature is varied.

Temperature (Hydrogen Peroxide Source)

In one embodiment, in Step 1A the hydrogen peroxide source is chilled to and held at from about 0° C. to about 5° C. In one embodiment, in Step 1A the hydrogen peroxide source is chilled to and held at from about 5° C. to about 10° C. In one embodiment, in Step 1A the hydrogen peroxide source is chilled to and held at from about 10° C. to about 15° C. In one embodiment, in Step 1A the hydrogen peroxide source is chilled to and held at from about 15° C. to about 20° C. In one embodiment, in Step 1A the hydrogen peroxide source is chilled to and held at from about 20° C. to about 25° C. In one embodiment, in Step 1A the hydrogen peroxide source is heated to and held at from about 20° C. to about 25° C. In one embodiment, in Step 1A the hydrogen peroxide source is heated to and held at from about 25° C. to about 30° C. In one embodiment, in Step 1A the hydrogen peroxide source is heated to and held at from about 30° C. to about 40° C.

In one embodiment, in Step 1A the hydrogen peroxide source is chilled to and held at about 0° C. In one embodiment, in Step 1A the hydrogen peroxide source is chilled to and held at about 5° C. In one embodiment, in Step 1A the hydrogen peroxide source is chilled to and held at about 10° C. In one embodiment, in Step 1A the hydrogen peroxide source is chilled to and held at about 15° C. In one embodiment, in Step 1A the hydrogen peroxide source is chilled to and held at about 20° C. In one embodiment, in Step 1A the hydrogen peroxide source is heated to and held at about 20° C. In one embodiment, in Step 1A the hydrogen peroxide source is heated to and held at about 25° C. In one embodiment, in Step 1A the hydrogen peroxide source is heated to and held at about 30° C. In one embodiment, in Step 1A the hydrogen peroxide source is heated to and held at about 40° C.

In one embodiment, the hydrogen peroxide source temperature is held substantially constant. In one embodiment, the hydrogen peroxide source temperature is varied.

Chamber (Reactor) Pressure

Oxidizing Vapor Pressures

In one embodiment, oxidizing vapor is delivered into the chamber from one port while an inert gas is delivered into the chamber from another port. In one embodiment, the oxidizing vapor is delivered into the chamber from one port while an additional oxidizing gas is delivered into the chamber from another port and an inert gas is delivered into the chamber from a third port. In one embodiment, the total pressure in the chamber during the oxidizing vapor delivery is from about 0.1 Torr to about 1.0 Torr. In one embodiment, the total pressure in the chamber during the oxidizing vapor delivery is from about 0.5 Torr to about 5.0 Torr. In one embodiment, the total pressure in the chamber during the oxidizing vapor delivery is from about 0.5 Torr to about 2.0 Torr. In one embodiment, the total pressure in the chamber during the oxidizing vapor delivery is from about 0.5 Torr to about 1.0 Torr. In one embodiment, the total pressure in the chamber during the oxidizing vapor delivery is from about 0.5 Torr to about 0.75 Torr. In one embodiment, the total pressure in the chamber during the oxidizing vapor delivery is from about 1.0 Torr to about 5.0 Torr. In one embodiment, the total pressure in the chamber during the oxidizing vapor delivery is from about 1.0 Torr to about 10.0 Torr. In one embodiment, the total pressure in the chamber during the oxidizing vapor delivery is from about 2.0 Torr to about 10.0 Torr. In one embodiment, the total pressure in the chamber during the oxidizing vapor delivery is from about 10.0 Torr to about 25.0 Torr. In one embodiment, the total pressure in the chamber during the oxidizing vapor delivery is from about 10.0 Torr to about 50.0 Torr. In one embodiment, the total pressure in the chamber during the oxidizing vapor delivery is from about 25.0 Torr to about 50.0 Torr. In one embodiment, the total pressure in the chamber during the oxidizing vapor delivery is from about 50.0 Torr to about 75.0 Torr. In one embodiment, the total pressure in the chamber during the oxidizing vapor delivery is from about 75.0 Torr to about 100.0 Torr. In one embodiment, the total pressure in the chamber during the oxidizing vapor delivery is from about 1.0 Torr to about 100.0 Torr. In one embodiment, the total pressure in the chamber during the oxidizing vapor delivery is from about 10.0 Torr to about 100.0 Torr.

In one embodiment, the total pressure in the chamber during the oxidizing vapor delivery is about 0.1 Torr. In one embodiment, the total pressure in the chamber during the oxidizing vapor delivery is about 0.25 Torr. In one embodiment, the total pressure in the chamber during the oxidizing vapor delivery is about 0.5 Torr. In one embodiment, the total pressure in the chamber during the oxidizing vapor delivery is about 0.75 Torr. In one embodiment, the total pressure in the chamber during the oxidizing vapor delivery is about 1.0 Torr. In one embodiment, the total pressure in the chamber during the oxidizing vapor delivery is about 2.0 Torr. In one embodiment, the total pressure in the chamber during the oxidizing vapor delivery is about 3.0 Torr. In one embodiment, the total pressure in the chamber during the oxidizing vapor delivery is about 4.0 Torr. In one embodiment, the total pressure in the chamber during the oxidizing vapor delivery is about 5.0 Torr. In one embodiment, the total pressure in the chamber during the oxidizing vapor delivery is about 10.0 Torr. In one embodiment, the total pressure in the chamber during the oxidizing vapor delivery is about 15.0 Torr. In one embodiment, the total pressure in the chamber during the oxidizing vapor delivery is about 20.0 Torr. In one embodiment, the total pressure in the chamber during the oxidizing vapor delivery is about 50.0 Torr. In one embodiment, the total pressure in the chamber during the oxidizing vapor delivery is about 75.0 Torr. In one embodiment, the total pressure in the chamber during the oxidizing vapor delivery is about 100.0 Torr.

Water Vapor Pressures

In one embodiment, water vapor is delivered into the chamber from one port while an inert gas is delivered into the chamber from another port. In one embodiment, the total pressure in the chamber during the water vapor delivery is from about 0.1 Torr to about 1.0 Torr. In one embodiment, the total pressure in the chamber during the water vapor delivery is from about 0.5 Torr to about 5.0 Torr. In one embodiment, the total pressure in the chamber during the water vapor delivery is from about 0.5 Torr to about 2.0 Torr. In one embodiment, the total pressure in the chamber during the water vapor delivery is from about 0.5 Torr to about 1.0

Torr. In one embodiment, the total pressure in the chamber during the water vapor delivery is from about 0.5 Torr to about 0.75 Torr. In one embodiment, the total pressure in the chamber during the water vapor delivery is from about 1.0 Torr to about 5.0 Torr. In one embodiment, the total pressure in the chamber during the water vapor delivery is from about 1.0 Torr to about 10.0 Torr. In one embodiment, the total pressure in the chamber during the water vapor delivery is from about 2.0 Torr to about 10.0 Torr. In one embodiment, the total pressure in the chamber during the water vapor delivery is from about 10.0 Torr to about 25.0 Torr. In one embodiment, the total pressure in the chamber during the water vapor delivery is from about 10.0 Torr to about 50.0 Torr. In one embodiment, the total pressure in the chamber during the water vapor delivery is from about 25.0 Torr to about 50.0 Torr. In one embodiment, the total pressure in the chamber during the water vapor delivery is from about 50.0 Torr to about 75.0 Torr. In one embodiment, the total pressure in the chamber during the water vapor delivery is from about 75.0 Torr to about 100.0 Torr. In one embodiment, the total pressure in the chamber during the water vapor delivery is from about 1.0 Torr to about 100.0 Torr. In one embodiment, the total pressure in the chamber during the water vapor delivery is from about 10.0 Torr to about 100.0 Torr.

In one embodiment, the total pressure in the chamber during the water vapor delivery is about 0.1 Torr. In one embodiment, the total pressure in the chamber during the water vapor delivery is about 0.25 Torr. In one embodiment, the total pressure in the chamber during the water vapor delivery is about 0.5 Torr. In one embodiment, the total pressure in the chamber during the water vapor delivery is about 0.75 Torr. In one embodiment, the total pressure in the chamber during the water vapor delivery is about 1.0 Torr. In one embodiment, the total pressure in the chamber during the water vapor delivery is about 2.0 Torr. In one embodiment, the total pressure in the chamber during the water vapor delivery is about 3.0 Torr. In one embodiment, the total pressure in the chamber during the water vapor delivery is about 4.0 Torr. In one embodiment, the total pressure in the chamber during the water vapor delivery is about 5.0 Torr. In one embodiment, the total pressure in the chamber during the water vapor delivery is about 10.0 Torr. In one embodiment, the total pressure in the chamber during the water vapor delivery is about 15.0 Torr. In one embodiment, the total pressure in the chamber during the water vapor delivery is about 20.0 Torr. In one embodiment, the total pressure in the chamber during the water vapor delivery is about 50.0 Torr. In one embodiment, the total pressure in the chamber during the water vapor delivery is about 75.0 Torr. In one embodiment, the total pressure in the chamber during the water vapor delivery is about 100.0 Torr.

Mixed/Combined Oxidizing Vapor Pressures

In one embodiment, water vapor is delivered into the chamber from one port while an additional oxidizing gas is delivered into the chamber from another port to form a mixed or combined oxidizing vapor and an inert gas is delivered into the chamber from a third port. In one embodiment, the total pressure in the chamber during the oxidizing vapor delivery is from about 0.1 Torr to about 1.0 Torr. In one embodiment, the total pressure in the chamber during the oxidizing vapor delivery is from about 0.5 Torr to about 5.0 Torr. In one embodiment, the total pressure in the chamber during the oxidizing vapor delivery is from about 0.5 Torr to about 2.0 Torr. In one embodiment, the total pressure in the chamber during the oxidizing vapor delivery is from about 0.5 Torr to about 1.0 Torr. In one embodiment, the total pressure in the chamber during the oxidizing vapor delivery is from about 0.5 Torr to about 0.75 Torr. In one embodiment, the total pressure in the chamber during the oxidizing vapor delivery is from about 1.0 Torr to about 5.0 Torr. In one embodiment, the total pressure in the chamber during the oxidizing vapor delivery is from about 1.0 Torr to about 10.0 Torr. In one embodiment, the total pressure in the chamber during the oxidizing vapor delivery is from about 2.0 Torr to about 10.0 Torr. In one embodiment, the total pressure in the chamber during the oxidizing vapor delivery is from about 10.0 Torr to about 25.0 Torr. In one embodiment, the total pressure in the chamber during the oxidizing vapor delivery is from about 10.0 Torr to about 50.0 Torr. In one embodiment, the total pressure in the chamber during the oxidizing vapor delivery is from about 25.0 Torr to about 50.0 Torr. In one embodiment, the total pressure in the chamber during the oxidizing vapor delivery is from about 50.0 Torr to about 75.0 Torr. In one embodiment, the total pressure in the chamber during the oxidizing vapor delivery is from about 75.0 Torr to about 100.0 Torr. In one embodiment, the total pressure in the chamber during the oxidizing vapor delivery is from about 1.0 Torr to about 100.0 Torr. In one embodiment, the total pressure in the chamber during the oxidizing vapor delivery is from about 10.0 Torr to about 100.0 Torr.

In one embodiment, the total pressure in the chamber during the oxidizing vapor delivery is about 0.1 Torr. In one embodiment, the total pressure in the chamber during the oxidizing vapor delivery is about 0.25 Torr. In one embodiment, the total pressure in the chamber during the oxidizing vapor delivery is about 0.5 Torr. In one embodiment, the total pressure in the chamber during the oxidizing vapor delivery is about 0.75 Torr. In one embodiment, the total pressure in the chamber during the oxidizing vapor delivery is about 1.0 Torr. In one embodiment, the total pressure in the chamber during the oxidizing vapor delivery is about 2.0 Torr. In one embodiment, the total pressure in the chamber during the oxidizing vapor delivery is about 3.0 Torr. In one embodiment, the total pressure in the chamber during the oxidizing vapor delivery is about 4.0 Torr. In one embodiment, the total pressure in the chamber during the oxidizing vapor delivery is about 5.0 Torr. In one embodiment, the total pressure in the chamber during the oxidizing vapor delivery is about 10.0 Torr. In one embodiment, the total pressure in the chamber during the oxidizing vapor delivery is about 15.0 Torr. In one embodiment, the total pressure in the chamber during the oxidizing vapor delivery is about 20.0 Torr. In one embodiment, the total pressure in the chamber during the oxidizing vapor delivery is about 50.0 Torr. In one embodiment, the total pressure in the chamber during the oxidizing vapor delivery is about 75.0 Torr. In one embodiment, the total pressure in the chamber during the oxidizing vapor delivery is about 100.0 Torr.

In a further aspect of the forgoing embodiments and aspects thereof, the additional oxidizing gas includes one or more of oxygen, ozone, nitrous oxide and hydrogen peroxide. In a further aspect of the forgoing embodiments and aspects thereof, the additional oxidizing gas includes oxygen. In a further aspect of the forgoing embodiments and aspects thereof, the additional oxidizing gas includes ozone. In a further aspect of the forgoing embodiments and aspects thereof, the additional oxidizing gas includes nitrous oxide. In a further aspect of the forgoing embodiments and aspects thereof, the additional oxidizing gas includes hydrogen peroxide.

Delivery Method

In one embodiment, the oxidizing vapor is delivered by vapor-draw. In one embodiment, the oxidizing vapor is delivered with the aid of a carrier gas. In one embodiment, the oxidizing vapor is delivered by bubbling an inert gas through water. In one embodiment, the oxidizing vapor is delivered as a gas (i.e., without bubbling through water). In one embodiment, the oxidizing vapor is delivered simultaneously with an additional oxidizing vapor.

Step 1B: Inert Gas Purge

Purge Gas

When performing Step 1B, any suitable inert purge gas can be used. In one embodiment, the purge gas includes argon. In one embodiment, the purge gas includes nitrogen.

Time

In one embodiment, the Step 1B purge time is from about 0.5 seconds to about 30 seconds. In one embodiment, the Step 1B purge time is from about 1 second to about 5 seconds. In one embodiment, the Step 1B purge time is from about 10 seconds to about 30 seconds. In one embodiment, the Step 1B purge time is from about 0.5 seconds to about 10 seconds. In one embodiment, the Step 1B purge time exposure is from about 1 second to about 7 seconds. In one embodiment, the Step 1B purge time exposure is from about 7 seconds to about 10 seconds. In one embodiment, the Step 1B purge time exposure is from about 10 seconds to about 20 seconds. In one embodiment, the Step 1B purge time exposure is from about 20 seconds to about 30 seconds. In one embodiment, the Step 1B purge time exposure is about 0.25 seconds. In one embodiment, the Step 1B purge time exposure is about 0.5 seconds. In one embodiment, the Step 1B purge time exposure is about 1 second. In one embodiment, the Step 1B purge time exposure is about 2 seconds. In one embodiment, the Step 1B purge time exposure is about 3 seconds. In one embodiment, the Step 1B purge time exposure is about 4 seconds. In one embodiment, the Step 1B purge time exposure is about 5 seconds. In one embodiment, the Step 1B purge time exposure is about 6 seconds. In one embodiment, the Step 1B purge time exposure is about 7 seconds. In one embodiment, the Step 1B purge time exposure is about 8 seconds. In one embodiment, the Step 1B purge time exposure is about 9 seconds. In one embodiment, the Step 1B purge time exposure is about 10 seconds. In one embodiment, the Step 1B purge time exposure is about 12 seconds. In one embodiment, the Step 1B purge time exposure is about 15 seconds. In one embodiment, the Step 1B purge time exposure is about 17 seconds. In one embodiment, the Step 1B purge time exposure is about 20 seconds. In one embodiment, the Step 1B purge time exposure is about 25 seconds. In one embodiment, the Step 1B purge time exposure is about 30 seconds.

Flow Rate

When performing Step 1B, the purge gas is flowed at between about 1 sccm to about 2000 sccm. In one embodiment, the purge gas is flowed at between about 3 sccm to about 8 sccm. In one embodiment, the purge gas is flowed at between about 100 sccm to about 2000 sccm. In one embodiment, the purge gas is flowed at between about 50 sccm to about 500 sccm. In one embodiment, the purge gas is flowed at between about 500 sccm to about 2000 sccm. In one embodiment, the purge gas is flowed at about 1 sccm. In one embodiment, the purge gas is flowed at about 2 sccm. In one embodiment, the purge gas is flowed at about 3 sccm. In one embodiment, the purge gas is flowed at about 4 sccm. In one embodiment, the purge gas is flowed at about 5 sccm. In one embodiment, the purge gas is flowed at about 6 sccm. In one embodiment, the purge gas is flowed at about 7 sccm. In one embodiment, the purge gas is flowed at about 8 sccm. In one embodiment, the purge gas is flowed at about 9 sccm. In one embodiment, the purge gas is flowed at about 10 sccm. In one embodiment, the purge gas is flowed at about 9 sccm. In one embodiment, the purge gas is flowed at about 10 sccm. In one embodiment, the purge gas is flowed at about 50 sccm. In one embodiment, the purge gas is flowed at about 100 sccm. In one embodiment, the purge gas is flowed at about 200 sccm. In one embodiment, the purge gas is flowed at about 300 sccm. In one embodiment, the purge gas is flowed at about 500 sccm. In one embodiment, the purge gas is flowed at about 750 sccm. In one embodiment, the purge gas is flowed at about 1000 sccm. In one embodiment, the purge gas is flowed at about 1250 sccm. In one embodiment, the purge gas is flowed at about 1500 sccm. In one embodiment, the purge gas is flowed at about 1750 sccm. In one embodiment, the purge gas is flowed at about 2000 sccm.

Step 2: Volatilizer Exposure Sequence

Step 2 includes, consists essentially of or consists of sequentially exposing a modified metal surface to one or more volatilizer (Step 2A) and purging with an inert gas (step 2B). The one or more volatilizer includes, consists essentially of, or consists of a halogen-free organic acid or mixture of halogen-free organic acids.

In one embodiment, the one or more volatilizer includes one or more of propionic acid, isobutyric acid, pivalic acid, acetic acid, butanoic acid, acrylic acid, methacrylic acid, 2-methylbutanoic acid, 3-methylbutanoic acid, 3-butenoic acid, cyclopropanecarboxylic acid, pentanoic acid, (2E)-but-2-enoic acid, (Z)-2-butenoic acid and combinations thereof. In one embodiment, the one or more volatilizer includes one or more of propionic acid, isobutyric acid, pivalic acid, acetic acid, butanoic acid, acrylic acid, methacrylic acid, 2-methylbutanoic acid, 3-methylbutanoic acid, 3-butenoic acid and combinations thereof. In one embodiment, the one or more volatilizer includes one or more of propionic acid, isobutyric acid, pivalic acid, acetic acid, butanoic acid and combinations thereof. In one embodiment, the one or more volatilizer includes one or more of propionic acid, isobutyric acid, pivalic acid and combinations thereof. In one aspect of this embodiment, the one or more volatilizer includes propionic acid. In one aspect of this embodiment, the one or more volatilizer includes isobutyric acid. In one aspect of this embodiment, the one or more volatilizer includes pivalic acid. In one aspect of this embodiment, the one or more volatilizer includes acetic acid. In one aspect of this embodiment, the one or more volatilizer includes butanoic acid. In one aspect of this embodiment, the one or more volatilizer includes acrylic acid. In one aspect of this embodiment, the one or more volatilizer includes methacrylic acid. In one aspect of this embodiment, the one or more volatilizer includes 2-methylbutanoic acid. In one aspect of this embodiment, the one or more volatilizer includes 3-methylbutanoic acid. In one aspect of this embodiment, the one or more volatilizer includes 3-butenoic acid. In one aspect of this embodiment, the one or more volatilizer includes cyclopropanecarboxylic acid. In one aspect of this embodiment, the one or more volatilizer includes pentanoic acid. In one aspect of this embodiment, the one or more volatilizer includes (2E)-but-2-enoic acid. In one aspect of this embodiment, the one or more volatilizer includes (Z)-2-butenoic acid. In one aspect of this embodiment, the one or more volatilizer includes a mixture of one or more of propionic acid, isobutyric acid and pivalic acid. In one aspect of this embodiment, the one or more volatilizer includes a mixture of two or more of propionic acid, isobutyric acid and pivalic acid. In one aspect of this embodiment, the one or more volatilizer includes a mixture of halogen-free organic acids including one or more of propionic acid, isobutyric acid and pivalic acid.

Step 2A: Volatilizer Exposure

Time

In one embodiment, the Step 2A one or more volatilizer exposure is from about 0.25 seconds to about 15 seconds. In one embodiment, the Step 2A one or more volatilizer exposure is from about 0.25 seconds to about 1 second. In one embodiment, the Step 2A one or more volatilizer exposure is from about 0.5 seconds to about 2 seconds. In one embodiment, the Step 2A one or more volatilizer exposure is from about 2 seconds to about 15 seconds. In one embodiment, the Step 2A one or more volatilizer exposure is about 0.25 seconds. In one embodiment, the Step 2A one or more volatilizer exposure is about 0.5 seconds. In one embodiment, the Step 2A one or more volatilizer exposure is about 1 second. In one embodiment, the Step 2A one or more volatilizer exposure is about 2 seconds. In one embodiment, the Step 2A one or more volatilizer exposure is about 3 seconds. In one embodiment, the Step 2A one or more volatilizer exposure is about 4 seconds. In one embodiment, the Step 2A one or more volatilizer exposure is about 5 seconds. In one embodiment, the Step 2A one or more volatilizer exposure is about 6 seconds. In one embodiment, the Step 2A one or more volatilizer exposure is about 8 seconds. In one embodiment, the Step 2A one or more volatilizer exposure is about 10 seconds. In one embodiment, the Step 2A volatilizer exposure is about 12 seconds. In one embodiment, the Step 2A one or more volatilizer exposure is about 15 seconds.

Chamber (Reactor) Temperature

In one embodiment, in Step 2A the one or more volatilizer is heated to and held at from about 50° C. to about 100° C. In one embodiment, in Step 2A the one or more volatilizer is heated to and held at from about 55° C. to about 95° C. In one embodiment, in Step 2A the one or more volatilizer is heated to and held at from about 60° C. to about 90° C. In one embodiment, in Step 2A the one or more volatilizer is heated to and held at from about 65° C. to about 85° C. In one embodiment, in Step 2A the one or more volatilizer is heated to and held at from about 70° C. to about 80° C. In one embodiment, in Step 2A the one or more volatilizer is heated to and held at about 50° C. In one embodiment, the Step 2A one or more volatilizer exposure is about 55° C. In one embodiment, in Step 2A the one or more volatilizer is heated to and held at about 60° C. In one embodiment, in Step 2A the one or more volatilizer is heated to and held at about 65° C. In one embodiment, in Step 2A the one or more volatilizer is heated to and held at about 70° C. In one embodiment, in Step 2A the one or more volatilizer is heated to and held at about 75° C. In one embodiment, in Step 2A the one or more volatilizer is heated to and held at about 80° C. In one embodiment, in Step 2A the one or more volatilizer is heated to and held at about 85° C. In one embodiment, in Step 2A the one or more volatilizer is heated to and held at about 90° C. In one embodiment, in Step 2A the one or more volatilizer is heated to and held at about 95° C. In one embodiment, in Step 2A the one or more volatilizer is heated to and held at about 100° C.

Delivery Method

In one embodiment, the one or more volatilizer is delivered by a flow-through mode without the assistance of a carrier gas as discussed below. In another embodiment, the one or more volatilizer is delivered by a flow-through mode with the assistance of a carrier gas as discussed below.

In one embodiment, the one or more volatilizer is delivered and "trapped" in which the reactor chamber is closed and the one or more volatilizer is "trapped" in the reactor. In one aspect of this embodiment, the one or more volatilizer is delivered using carrier gas (e.g., nitrogen or argon) as discussed below. In one aspect of this embodiment, the deposition chamber outlet is closed prior to the delivery of the one or more volatilizer, so as to keep it trapped in the chamber. In one aspect of this embodiment, the reactor outlet is kept closed for a time of approximately 0.1 second to a time of approximately 10 seconds to keep the one or more volatilizer trapped in the reactor in order to maximize its impact before opening the reactor to evacuate the gases.

Chamber (Reactor) Pressure

In one embodiment, the total pressure in the chamber during the one or more volatilizer delivery is from about 0.1 Torr to about 1.0 Torr. In one embodiment, the total pressure in the chamber during the one or more volatilizer delivery is from about 0.5 Torr to about 5.0 Torr. In one embodiment, the total pressure in the chamber during the one or more volatilizer delivery is from about 0.5 Torr to about 2.0 Torr. In one embodiment, the total pressure in the chamber during the one or more volatilizer delivery is from about 0.5 Torr to about 1.0 Torr. In one embodiment, the total pressure in the chamber during the one or more volatilizer delivery is from about 0.5 Torr to about 0.75 Torr. In one embodiment, the total pressure in the chamber during the one or more volatilizer delivery is from about 1.0 Torr to about 5.0 Torr. In one embodiment, the total pressure in the chamber during the one or more volatilizer delivery is from about 1.0 Torr to about 10.0 Torr. In one embodiment, the total pressure in the chamber during the one or more volatilizer delivery is from about 2.0 Torr to about 10.0 Torr. In one embodiment, the total pressure in the chamber during the one or more volatilizer delivery is from about 10.0 Torr to about 25.0 Torr. In one embodiment, the total pressure in the chamber during the one or more volatilizer delivery is from about 10.0 Torr to about 50.0 Torr. In one embodiment, the total pressure in the chamber during the one or more volatilizer delivery is from about 25.0 Torr to about 50.0 Torr. In one embodiment, the total pressure in the chamber during the one or more volatilizer delivery is from about 50.0 Torr to about 75.0 Torr. In one embodiment, the total pressure in the chamber during the pivalic acid delivery is from about 75.0 Torr to about 100.0 Torr. In one embodiment, the total pressure in the chamber during the one or more volatilizer delivery is from about 1.0 Torr to about 100.0 Torr. In one embodiment, the total pressure in the chamber during the one or more volatilizer delivery is from about 10.0 Torr to about 100.0 Torr.

In one embodiment, the total pressure in the chamber during the one or more volatilizer delivery is about 0.1 Torr. In one embodiment, the total pressure in the chamber during the one or more volatilizer delivery is about 0.25 Torr. In one embodiment, the total pressure in the chamber during the one or more volatilizer delivery is about 0.5 Torr. In one embodiment, the total pressure in the chamber during the one or more volatilizer delivery is about 0.75 Torr. In one embodiment, the total pressure in the chamber during the one or more volatilizer delivery is about 1.0 Torr. In one embodiment, the total pressure in the chamber during the one or more volatilizer delivery is about 2.0 Torr. In one embodiment, the total pressure in the chamber during the one or more volatilizer delivery is about 3.0 Torr. In one embodiment, the total pressure in the chamber during the one or more volatilizer delivery is about 4.0 Torr. In one embodiment, the total pressure in the chamber during the one or more volatilizer delivery is about 5.0 Torr. In one embodiment, the total pressure in the chamber during the one or more volatilizer delivery is about 10.0 Torr. In one embodiment, the total pressure in the chamber during the one or more volatilizer delivery is about 15.0 Torr. In one embodiment, the total pressure in the chamber during the one or more volatilizer delivery is about 20.0 Torr. In one embodiment, the total pressure in the chamber during the one or more volatilizer delivery is about 50.0 Torr. In one embodiment, the total pressure in the chamber during the one or more volatilizer delivery is about 75.0 Torr. In one embodiment, the total pressure in the chamber during the one or more volatilizer delivery is about 100.0 Torr.

Optional Carrier Gas

When performing Step 2B, any suitable inert carrier gas can be used if desired. In one embodiment, the carrier gas includes argon. In one embodiment, the carrier gas includes nitrogen.

Step 2B: Inert Gas Purge

Purge Gas

When performing Step 2B, any suitable inert purge gas can be used. In one embodiment, the purge gas includes argon. In one embodiment, the purge gas includes nitrogen.

Time

In one embodiment, the Step 2B purge time is from about 0.5 seconds to about 75 seconds. In one embodiment, the Step 2B purge time is from about 0.5 seconds to about 10 seconds. In one embodiment, the Step 2B purge time exposure is from about 1 second to about 7 seconds. In one embodiment, the Step 2B purge time exposure is from about 1 second to about 5 seconds. In one embodiment, the Step 2B purge time is from about 10 seconds to about 75 seconds. In one embodiment, the Step 2B purge time exposure is about 0.25 seconds. In one embodiment, the Step 2B purge time exposure is about 0.5 seconds. In one embodiment, the Step 2B purge time exposure is about 1 second. In one embodiment, the Step 2B purge time exposure is about 2 seconds. In one embodiment, the Step 2B purge time exposure is about 3 seconds. In one embodiment, the Step 2B purge time exposure is about 4 seconds. In one embodiment, the Step 2B purge time exposure is about 5 seconds. In one embodiment, the Step 2B purge time exposure is about 6 seconds. In one embodiment, the Step 2B purge time exposure is about 7 seconds. In one embodiment, the Step 2B purge time exposure is about 8 seconds. In one embodiment, the Step 2B purge time exposure is about 9 seconds. In one embodiment, the Step 2B purge time exposure is about 10 seconds. In one embodiment, the Step 2B purge time exposure is about 15 seconds. In one embodiment, the Step 2B purge time exposure is about 20 seconds. In one embodiment, the Step 2B purge time exposure is about 25 seconds. In one embodiment, the Step 2B purge time exposure is about 30 seconds. In one embodiment, the Step 2B purge time exposure is about 40 seconds. In one embodiment, the Step 2B purge time exposure is about 50 seconds. In one embodiment, the Step 2B purge time exposure is about 60 seconds. In one embodiment, the Step 2B purge time exposure is about 75 seconds.

In one embodiment, the last purge time before a new cycle begins is extended (i.e., an extended purge). In one embodiment, the extended purge time is from about 30 seconds to 60 seconds. In one embodiment, the extended purge time is from about 30 seconds to 45 seconds. In one embodiment, the extended purge time is about 30 seconds. In one embodiment, the extended purge time is about 45 seconds. In one embodiment, the extended purge time is about 60 seconds.

Flow Rate

When performing Step 2B, the purge gas is flowed at between about 1 sccm to about 2000 sccm. In one embodiment, the purge gas is flowed at between about 3 sccm to about 8 sccm. In one embodiment, the purge gas is flowed at between about 100 sccm to about 2000 sccm. In one embodiment, the purge gas is flowed at between about 50 sccm to about 500 sccm. In one embodiment, the purge gas is flowed at between about 500 sccm to about 2000 sccm. In one embodiment, the purge gas is flowed at about 1 sccm. In one embodiment, the purge gas is flowed at about 2 sccm. In one embodiment, the purge gas is flowed at about 3 sccm. In one embodiment, the purge gas is flowed at about 4 sccm. In one embodiment, the purge gas is flowed at about 5 sccm. In one embodiment, the purge gas is flowed at about 6 sccm. In one embodiment, the purge gas is flowed at about 7 sccm. In one embodiment, the purge gas is flowed at about 8 sccm. In one embodiment, the purge gas is flowed at about 9 sccm. In one embodiment, the purge gas is flowed at about 10 sccm. In one embodiment, the purge gas is flowed at about 9 sccm. In one embodiment, the purge gas is flowed at about 10 sccm. In one embodiment, the purge gas is flowed at about 50 sccm. In one embodiment, the purge gas is flowed at about 100 sccm. In one embodiment, the purge gas is flowed at about 200 sccm. In one embodiment, the purge gas is flowed at about 300 sccm. In one embodiment, the purge gas is flowed at about 500 sccm. In one embodiment, the purge gas is flowed at about 750 sccm. In one embodiment, the purge gas is flowed at about 1000 sccm. In one embodiment, the purge gas is flowed at about 1250 sccm. In one embodiment, the purge gas is flowed at about 1500 sccm. In one embodiment, the purge gas is flowed at about 1750 sccm. In one embodiment, the purge gas is flowed at about 2000 sccm.

Films

The disclosed and claimed subject matter further includes films prepared by the methods described herein.

In one embodiment, the films etched by the methods described herein have trenches, vias or other topographical features with an aspect ratio of about 0 to about 60. In a further aspect of this embodiment, the aspect ratio is about 0 to about 0.5. In a further aspect of this embodiment, the aspect ratio is about 0.5 to about 1. In a further aspect of this embodiment, the aspect ratio is about 1 to about 50. In a further aspect of this embodiment, the aspect ratio is about 1 to about 40. In a further aspect of this embodiment, the aspect ratio is about 1 to about 30. In a further aspect of this embodiment, the aspect ratio is about 1 to about 20. In a further aspect of this embodiment, the aspect ratio is about 1 to about 10. In a further aspect of this embodiment, the aspect ratio is about 0.1. In a further aspect of this embodiment, the aspect ratio is about 0.2. In a further aspect of this embodiment, the aspect ratio is about 0.3. In a further aspect of this embodiment, the aspect ratio is about 0.4. In a further aspect of this embodiment, the aspect ratio is about 0.5. In a further aspect of this embodiment, the aspect ratio is about 0.6. In a further aspect of this embodiment, the aspect ratio is about 0.8. In a further aspect of this embodiment, the aspect ratio is about 1. In a further aspect of this embodiment, the aspect ratio is greater than about 1. In a further aspect of this embodiment, the aspect ratio is greater than about 2. In a further aspect of this embodiment, the aspect ratio is greater than about 5. In a further aspect of this embodiment, the aspect ratio is greater than about 10. In a further aspect of this embodiment, the aspect ratio is greater than about 15. In a further aspect of this embodiment, the aspect ratio is greater than about 20. In a further aspect of this embodiment, the aspect ratio is greater than about 30. In a further aspect of this embodiment, the aspect ratio is greater than about 40. In a further aspect of this embodiment, the aspect ratio is greater than about 50. In a further aspect of the forgoing embodiments and aspects thereof, the metal includes copper, cobalt, molybdenum and tungsten. In a further aspect of the forgoing embodiments and aspects thereof, the metal includes copper. In a further aspect of the forgoing embodiments and aspects thereof, the metal includes cobalt. In a further aspect of the forgoing embodiments and aspects thereof, the metal includes molybdenum. In a further aspect of the forgoing embodiments and aspects thereof, the metal includes tungsten.

In another embodiment, the films etched by the methods described herein have a resistivity of between about 1 μΩ·cm to about 250 μΩ·cm. In a further aspect of this embodiment, the films have a resistivity of about 1 μΩ·cm to about 5 μΩ·cm. In a further aspect of this embodiment, the films have a resistivity of about 3 μΩ·cm to about 4 μΩ·cm. In a further aspect of this embodiment, the films have a resistivity of about 5 μΩ·cm to about 10 μΩ·cm. In a further aspect of this embodiment, the films have a resistivity of about 10 μΩ·cm to about 50 μΩ·cm. In a further aspect of this embodiment, the films have a resistivity of about 50 μΩ·cm to about 100 μΩ·cm. In a further aspect of this embodiment, the films have a resistivity of about 100 μΩ·cm to about 250 μΩ·cm. In a further aspect of this embodiment, the films have a resistivity of about 1 μΩ·cm. In a further aspect of this embodiment, the films have a resistivity of about 2 μΩ·cm. In a further aspect of this embodiment, the films have a resistivity of about 3 μΩ·cm. In a further aspect of this embodiment, the films have a resistivity of about 4 μΩ·cm. In a further aspect of this embodiment, the films have a resistivity of about 5 μΩ·cm. In a further aspect of this embodiment, the films have a resistivity of about 7.5 μΩ·cm. In a further aspect of this embodiment, the films have a resistivity of about 10 μΩ·cm. In a further aspect of this embodiment, the films have a resistivity of about 15 μΩ·cm. In a further aspect of this embodiment, the films have a resistivity of about 20 μΩ·cm. In a further aspect of this embodiment, the films have a resistivity of about 30 μΩ·cm. In a further aspect of this embodiment, the films have a resistivity of about 40 μΩ·cm. In a further aspect of this embodiment, the films have a resistivity of about 50 μΩ·cm. In a further aspect of this embodiment, the films have a resistivity of about 60 μΩ·cm. In a further aspect of this embodiment, the films have a resistivity of about 80 μΩ·cm. In a further aspect of this embodiment, the films have a resistivity of about 100 μΩ·cm. In a further aspect of this embodiment, the films have a resistivity of about 150 μΩ·cm. In a further aspect of this embodiment, the films have a resistivity of about 200 μΩ·cm. In a further aspect of this embodiment, the films have a resistivity of about 250 μΩ·cm. In a further aspect of the forgoing embodiments and aspects thereof, the metal includes copper, cobalt, molybdenum and tungsten. In a further aspect of the forgoing embodiments and aspects thereof, the metal includes copper. In a further aspect of the forgoing embodiments and aspects thereof the metal includes cobalt. In a further aspect of the forgoing embodiments and aspects thereof, the metal includes molybdenum. In a further aspect of the forgoing embodiments and aspects thereof, the metal includes tungsten.

Another aspect of the disclosed and claimed subject matter is the use of one or more of propionic acid, isobutyric acid, pivalic acid, acetic acid, butanoic acid, acrylic acid, methacrylic acid, 2-methylbutanoic acid, 3-methylbutanoic acid, 3-butenoic acid, cyclopropanecarboxylic acid, pentanoic acid, (2E)-but-2-enoic acid, (Z)-2-butenoic acid and combinations thereof as halogen-free organic volatalizer together with one or more of water vapor, oxygen, ozone, nitrous oxide, hydrogen peroxide, and oxygen plasma and combinations thereof as oxidizing vapor for selective thermal atomic layer etching of a metal substrate comprising one or more of copper, cobalt, molybdenum and tungsten.

EXAMPLES

Reference will now be made to more specific embodiments of the present disclosure and experimental results that provide support for such embodiments. The examples are given below to more fully illustrate the disclosed subject matter and should not be construed as limiting the disclosed subject matter in any way.

It will be apparent to those skilled in the art that various modifications and variations can be made in the disclosed subject matter and specific examples provided herein without departing from the spirit or scope of the disclosed subject matter. Thus, it is intended that the disclosed subject matter, including the descriptions provided by the following examples, covers the modifications and variations of the disclosed subject matter that come within the scope of any claims and their equivalents.

Materials and Methods

The experiments for Etching Conditions I through XIV and Examples 1 through 18 were performed in a cross flow ALD system capable of accommodating up to 8" diameter wafer sizes. Etching Conditions XV through XVII and Examples 19 through 24 were performed in an ALD system with a funnel lid (detailed below). Pivalic acid, isobutyric acid and propionic acid were obtained from MilliporeSigma.

- Etching Conditions I: One dose of pivalic acid and one dose of water.
- Etching Conditions II: One dose of pivalic acid.
- Etching Conditions III: Three doses of pivalic acid and three doses of water.
- Etching Conditions IV: Three doses of pivalic acid and one dose of water.
- Etching Conditions V: One dose of pivalic acid and three doses of water.
- Etching Conditions VI: Three doses of pivalic acid (at a higher temperature, 85° C.) and three doses of water.
- Etching Conditions VII: Two doses of water.
- Etching Conditions VIII: Three doses of pivalic acid (at a higher temperature, 85° C.) and one dose of water.
- Etching Conditions IX: Three doses of pivalic acid (at a lower temperature, 60° C.; trapped mode; delivered with nitrogen carrier gas) and two doses of water.
- Etching Conditions X: Three doses of pivalic acid (at a lower temperature, 60° C.; trapped mode; delivered with nitrogen carrier gas) and one dose of water.
- Etching Conditions XI: Thermal Treatment (at either 120° C. or 170° C.) without pivalic acid and water.
- Etching Conditions XII: Thermal Treatment (at 120° C.) with water.
- Etching Conditions XIII: Thermal Treatment (at 120° C.) with pivalic acid.
- Etching Conditions XIV: One dose of pivalic acid (at 75° C.; delivered with nitrogen carrier gas) and one dose of water.
- Etching Conditions XV: One dose of pivalic acid only at a lower temperature of pivalic acid (50° C.).

Etching Conditions XVI: One dose of pivalic acid and one dose of water+oxygen.

Etching Conditions XVII: One dose of pivalic acid and either one, two, or three doses of water+oxygen.

Etching Conditions XVIII: One dose of pivalic acid and three doses of hydrogen peroxide.

Etching Conditions XIX: One dose of isobutyric acid and two or four doses of oxygen.

Etching Conditions XX: One dose of isobutyric acid and four doses of water+oxygen.

Etching Conditions XXI: One dose of propionic acid and two or four doses of oxygen.

Etching Conditions XXII: One dose of propionic acid and two doses of water+oxygen.

Example 1: Cobalt ALE Under Standard Conditions

In this example, ALE was performed under Etching Conditions I with the process chamber outer heater set at 280° C. and the process chamber inner heater set at 335° C. over the course of 350 cycles with each cycle including one dose of pivalic acid and one dose of water as follows:

(a) a 0.5-second exposure of water vapor, $H_2O$ (delivered by vapor-draw, while held at a temperature slightly higher than room temperature (about 30° C.), which resulted in a pressure spike of 0.650-0.700 Torr);

(b) a 5-second purge with 5 sccm of nitrogen;

(c) a 0.5-second exposure of pivalic acid, $(CH_3)_3C$—COOH (delivered by vapor-draw; heated to and held at about 80° C. (uncorrected temperature), which resulted in a pressure spike of 0.930-0.960 Torr) (note: the pivalic acid was used in a flow-through mode without the assistance of a carrier gas); and (d) a 5-second purge with 5 sccm of nitrogen.

After 350 cycles, (i) 17 Å of cobalt were etched from the cobalt coupon placed near the process chamber inlet (heated to about 280° C.) representing an etch rate of 0.049 Å/cycle, (ii) a maximum of 29 Å of cobalt were etched from the cobalt coupon placed near the center of the process chamber (heated to about 335° C.) representing an etch rate of 0.083 Å/cycle and (iii), 19 Å of cobalt were etched from the cobalt coupon placed near the process chamber outlet (heated to about 280° C.) representing an etch rate of 0.054 Å/cycle.

Example 2: Cobalt ALE Under Standard Conditions

In this example, ALE was performed under Etching Conditions II with the process chamber outer heater set at 280° C. and the process chamber inner heater set at 335° C. over the course of 350 cycles. Each etching cycle included:

(a) a 0.5-second exposure of pivalic acid, $(CH_3)_3C$—COOH (delivered by vapor-draw; while heated to and held at 80° C. (uncorrected temperature), which resulted in a pressure spike of 0.930-0.960 Torr) (note: the pivalic acid was used in a flow-through mode without the assistance of a carrier gas); and (b) followed by a 5-second purge with 5 sccm of nitrogen.

After 350 cycles, (i) approximately 0 Å of cobalt were etched from the cobalt coupon placed near the process chamber inlet (heated to about 280° C.), (ii) approximately 3 Å of cobalt were etched from the cobalt coupon placed near the center of the process chamber (heated to about 335° C.); and (iii) and approximately 8 Å of cobalt were etched from the cobalt coupon placed near the process chamber outlet (heated to about 280° C.). Given the degree uncertainty on such low etching measurements, these measurements can be interpreted to mean that no cobalt etching took place.

Example 3: Cobalt ALE Under Standard Conditions

In this example, ALE was performed under Etching Conditions I with the process chamber outer heater set at 280° C. and the process chamber inner heater set at 335° C. over the course of 500 cycles with each cycle including one dose of pivalic acid and one dose of water as follows:

(a) a 0.5-second exposure of water vapor, $H_2O$ (delivered by vapor-draw, while held at a temperature slightly higher than room temperature (about 30° C.), which resulted in a pressure spike of 0.650-0.700 Torr);

(b) a 5-second purge with 5 sccm of nitrogen;

(c) a 0.5-second exposure of pivalic acid, $(CH_3)_3C$—COOH (delivered by vapor-draw; heated to and held at 80° C. (uncorrected temperature), which resulted in a pressure spike of 0.930-0.960 Torr) (note: the pivalic acid was used in a flow-through mode without the assistance of a carrier gas); and (d) a 5-second purge with 5 sccm of nitrogen.

After 350 cycles, (i) 27-30 Å of cobalt were etched from the cobalt coupon placed near the process chamber inlet (heated to about 280° C.) representing an etch rate of 0.054-0.060 Å/cycle, (ii) 37-41 Å of cobalt were etched from the cobalt coupon placed near the center of the process chamber (heated to about 335° C.) representing an etch rate of 0.074-0.082 Å/cycle and (iii) 28-40 Å of cobalt were etched from the cobalt coupon placed near the process chamber outlet (heated to about 280° C.) representing an etch rate of 0.056-0.080 Å/cycle. Etch ranges are provided reflecting that this experiment was repeated three times and was shown to be repeatable.

Example 4: Cobalt ALE Under Standard Conditions

In this example, ALE was performed under Etching Conditions III with the process chamber outer heater set at 280° C. and the process chamber inner heater set at 335° C. over the course of 500 cycles with each cycle including three doses of pivalic acid and three doses of water as follows:

(a) a 0.5-second exposure of water vapor, $H_2O$ (delivered by vapor-draw, while held at a temperature slightly higher than room temperature (about 30° C.), which resulted in a pressure spike of 0.650-0.700 Torr);

(b) a 1-second purge with 5 sccm of nitrogen;

(c) a 0.5-second exposure of water vapor, $H_2O$ (delivered by vapor-draw, while held at a temperature slightly higher than room temperature (about 30° C.), which resulted in a pressure spike of 0.650-0.700 Torr);

(d) a 1-second purge with 5 sccm of nitrogen;

(e) a 0.5-second exposure of water vapor, $H_2O$ (delivered by vapor-draw, while held at a temperature slightly higher than room temperature (about 30° C.), which resulted in a pressure spike of 0.650-0.700 Torr);

(f) a 5-second purge with 5 sccm of nitrogen;

(g) a 0.5-second exposure of pivalic acid, $(CH_3)_3C$—COOH (delivered by vapor-draw heated to and held at 80° C. (uncorrected temperature), which resulted in a pressure spike of 0.930-0.960 Torr) (note: the pivalic acid was used in a flow-through mode without the assistance of a carrier gas);

(h) a 1-second purge with 5 sccm of nitrogen;

(i) a 0.5-second exposure of pivalic acid, $(CH_3)_3C$—COOH (delivered by vapor-draw heated to and held at 80° C. (uncorrected temperature), which resulted in a pressure spike of 0.930-0.960 Torr) (note: the pivalic acid was used in a flow-through mode without the assistance of a carrier gas);

(j) a 1-second purge with 5 sccm of nitrogen;

(k) a 0.5-second exposure of pivalic acid, $(CH_3)_3C$—COOH (delivered by vapor-draw heated to and held at 80° C. (uncorrected temperature), which resulted in a pressure spike of 0.930-0.960 Torr) (note: the pivalic acid was used in a flow-through mode without the assistance of a carrier gas); and (l) a 5-second purge with 5 sccm of nitrogen.

After 500 cycles, (i) 56 Å of cobalt were etched from the cobalt coupon placed near the process chamber inlet (heated to about 280° C.) representing an etch rate of 0.112 Å/cycle, (ii) 60 Å of cobalt were etched from the cobalt coupon placed near the center of the process chamber (heated to about 335° C.) representing an etch rate of 0.120 Å/cycle and (iii) 59 Å of cobalt were etched from the cobalt coupon placed near the process chamber outlet (heated to about 280° C.) representing an etch rate of 0.118 Å/cycle.

Example 5: Cobalt ALE Under Standard Conditions

In this example, ALE was performed under Etching Conditions III with the process chamber outer heater set at 280° C. and the process chamber inner heater set at 335° C. over the course of 250 cycles with each cycle including three doses of pivalic acid and three doses of water as follows:

(a) a 0.5-second exposure of water vapor, $H_2O$ (delivered by vapor-draw, while held at a temperature slightly higher than room temperature (about 30° C.), which resulted in a pressure spike of 0.650-0.700 Torr);

(b) a 1-second purge with 5 sccm of nitrogen;

(c) a 0.5-second exposure of water vapor, $H_2O$ (delivered by vapor-draw, while held at a temperature slightly higher than room temperature (about 30° C.), which resulted in a pressure spike of 0.650-0.700 Torr);

(d) a 1-second purge with 5 sccm of nitrogen;

(e) a 0.5-second exposure of water vapor, $H_2O$ (delivered by vapor-draw, while held at a temperature slightly higher than room temperature (about 30° C.), which resulted in a pressure spike of 0.650-0.700 Torr);

(f) a 5-second purge with 5 sccm of nitrogen;

(g) a 0.5-second exposure of pivalic acid, $(CH_3)_3C$—COOH (delivered by vapor-draw heated to and held at 80° C. (uncorrected temperature), which resulted in a pressure spike of 0.930-0.960 Torr) (note: the pivalic acid was used in a flow-through mode without the assistance of a carrier gas);

(h) a 1-second purge with 5 sccm of nitrogen;

(i) a 0.5-second exposure of pivalic acid, $(CH_3)_3C$—COOH (delivered by vapor-draw heated to and held at 80° C. (uncorrected temperature), which resulted in a pressure spike of 0.930-0.960 Torr) (note: the pivalic acid was used in a flow-through mode without the assistance of a carrier gas);

(j) a 1-second purge with 5 sccm of nitrogen;

(k) a 0.5-second exposure of pivalic acid, $(CH_3)_3C$—COOH (delivered by vapor-draw heated to and held at 80° C. (uncorrected temperature), which resulted in a pressure spike of 0.930-0.960 Torr) (note: the pivalic acid was used in a flow-through mode without the assistance of a carrier gas); and (l) a 5-second purge with 5 sccm of nitrogen.

After 250 cycles, (i) 34 Å of cobalt were etched from the cobalt coupon placed near the process chamber inlet (heated to about 280° C.) representing an etch rate of 0.136 Å/cycle, (ii) 40 Å of cobalt were etched from the cobalt coupon placed near the center of the process chamber (heated to about 335° C.) representing an etch rate of 0.160 Å/cycle and (iii) 40 Å of cobalt were etched from the cobalt coupon placed near the process chamber outlet (heated to about 280° C.) representing an etch rate of 0.160 Å/cycle.

Example 6: Cobalt ALE Under Standard Conditions

In this example, ALE was performed under Etching Conditions IV with the process chamber outer heater set at 280° C. and the process chamber inner heater set at 335° C. over the course of 250 cycles with each cycle including three doses of pivalic acid and one dose of water as follows:

(a) a 0.5-second exposure of water vapor, $H_2O$ (delivered by vapor-draw, while held at a temperature slightly higher than room temperature (about 30° C.), which resulted in a pressure spike of 0.650-0.700 Torr);

(b) a 5-second purge with 5 sccm of nitrogen;

(c) a 0.5-second exposure of pivalic acid, $(CH_3)_3C$—COOH (delivered by vapor-draw heated to and held at 80° C. (uncorrected temperature), which resulted in a pressure spike of 0.930-0.960 Torr) (note: the pivalic acid was used in a flow-through mode without the assistance of a carrier gas);

(d) a 1-second purge with 5 sccm of nitrogen;

(e) a 0.5-second exposure of pivalic acid, $(CH_3)_3C$—COOH (delivered by vapor-draw heated to and held at 80° C. (uncorrected temperature), which resulted in a pressure spike of 0.930-0.960 Torr)) (note: the pivalic acid was used in a flow-through mode without the assistance of a carrier gas);

(f) a 1-second purge with 5 sccm of nitrogen;

(g) a 0.5-second exposure of pivalic acid, $(CH_3)_3C$—COOH (delivered by vapor-draw heated to and held at 80° C. (uncorrected temperature), which resulted in a pressure spike of 0.930-0.960 Torr) (note: the pivalic acid was used in a flow-through mode without the assistance of a carrier gas); and (h) a 5-second purge with 5 sccm of nitrogen.

After 250 cycles, (i) 40 Å of cobalt were etched from the cobalt coupon placed near the process chamber inlet (heated to about 280° C.) representing an etch rate of 0.160 Å/cycle, and (ii) 44 Å of cobalt were etched from the cobalt coupon placed near the center of the process chamber (heated to about 335° C.) representing an etch rate of 0.176 Å/cycle and (iii) 44 Å of cobalt were etched from the cobalt coupon placed near the process chamber outlet (heated to about 280° C.) representing an etch rate of 0.176 Å/cycle.

Example 7: Cobalt ALE Under Standard Conditions

In this example, ALE was performed under Etching Conditions IV with the process chamber outer heater set at 280° C. and the process chamber inner heater set at 335° C. over the course of 250 cycles with each cycle including one dose of pivalic acid and three doses of water as follows:

(a) a 0.5-second exposure of water vapor, $H_2O$ (delivered by vapor-draw, while held at a temperature slightly higher than room temperature (about 30° C.), which resulted in a pressure spike of 0.650-0.700 Torr);

(b) a 1-second purge with 5 sccm of nitrogen;

(c) a 0.5-second exposure of water vapor, $H_2O$ (delivered by vapor-draw, while held at a temperature slightly higher than room temperature (about 30° C.) which resulted in a pressure spike of 0.650-0.700 Torr);

(d) a 1-second purge with 5 sccm of nitrogen;

(e) a 0.5-second exposure of water vapor, $H_2O$ (delivered by vapor-draw, while held at a temperature slightly higher than room temperature (about 30° C.), which resulted in a pressure spike of 0.650-0.700 Torr);

(f) a 5-second purge with 5 sccm of nitrogen;

(g) a 0.5-second exposure of pivalic acid, $(CH_3)_3C$—COOH (delivered by vapor-draw heated to and held at 80° C. (uncorrected temperature), which resulted in a pressure spike of 0.930-0.960 Torr) (note: the pivalic acid was used in a flow-through mode without the assistance of a carrier gas); and (h) a 5-second purge with 5 sccm of nitrogen;

After 250 cycles, (i) 9 Å of cobalt were etched from the cobalt coupon placed near the process chamber inlet (heated to about 280° C.) representing an etch rate of 0.036 Å/cycle, (ii) 10 Å of cobalt were etched from the cobalt coupon placed near the center of the process chamber (heated to about 335° C.) representing an etch rate of 0.040 Å/cycle and (iii) 12 Å of cobalt were etched from the cobalt coupon placed near the process chamber outlet (heated to about 280° C.) representing an etch rate of 0.048 Å/cycle.

Example 8: Series of Cobalt ALE Under Standard Conditions

In this example, ALE was performed under Etching Conditions VI with the process chamber outer heater set at 280° C. and the process chamber inner heater set at 335° C. over the course of between 60-1000 cycles with each cycle including three doses of pivalic acid (at an elevated temperature of 85° C.) and three doses of water as follows:

(a) a 0.5-second exposure of water vapor, $H_2O$ (delivered by vapor-draw, while held at a temperature slightly higher than room temperature (about 30° C.), which resulted in a pressure spike of 0.650-0.700 Torr);

(b) a 1-second purge with 5 sccm of nitrogen;

(c) a 0.5-second exposure of water vapor, $H_2O$ (delivered by vapor-draw, while held at a temperature slightly higher than room temperature (about 30° C.), which resulted in a pressure spike of 0.650-0.700 Torr);

(d) a 1-second purge with 5 sccm of nitrogen;

(e) a 0.5-second exposure of water vapor, $H_2O$ (delivered by vapor-draw, while held at a temperature slightly higher than room temperature (about 30° C.), which resulted in a pressure spike of 0.650-0.700 Torr);

(f) a 5-second purge with 5 sccm of nitrogen;

(g) a 0.5-second exposure of pivalic acid, $(CH_3)_3C$—COOH (delivered by vapor-draw heated to and held at 85° C. (uncorrected temperature), which resulted in a pressure spike of 1.20-1.40 Torr) (note: the pivalic acid was used in a flow-through mode without the assistance of a carrier gas);

(h) a 1-second purge with 5 sccm of nitrogen;

(i) a 0.5-second exposure of pivalic acid, $(CH_3)_3C$—COOH (delivered by vapor-draw heated to and held at 85° C. (uncorrected temperature), which resulted in a pressure spike of 1.20-1.40 Torr) (note: the pivalic acid was used in a flow-through mode without the assistance of a carrier gas);

(j) a 1-second purge with 5 sccm of nitrogen;

(k) a 0.5-second exposure of pivalic acid, $(CH_3)_3C$—COOH (delivered by vapor-draw heated to and held at 85° C. (uncorrected temperature), which resulted in a pressure spike of 1.20-1.40 Torr) (note: the pivalic acid was used in a flow-through mode without the assistance of a carrier gas); and (l) a 5-second purge with 5 sccm of nitrogen.

After this process, a varying amount of cobalt was etched from the cobalt coupon placed near the center of the process chamber (heated to about 335° C.) representing varying etch rates, as shown in the Table 1 below. The etch rate decreased as the number of etch cycles increased, and this can be explained by the fact there is less and less cobalt remaining to be etched. The total thickness of cobalt film, prior to etch, was about 120 Å.

TABLE 1

| Cycle No. | Total Co Etched (Å) | Fraction of Co Film Remaining | Etch Rate (Å/Cycle) |
|---|---|---|---|
| 60 | 11 | 91% | 0.18 |
| 125 | 30 | 75% | 0.24 |
| 250 | 61 | 50% | 0.24 |
| 500 | 89 | 25% | 0.18 |
| 1000 | 110 | 9% | 0.11 |

Example 9: Cobalt ALE Under Standard Conditions

In this example, ALE was performed under Etching Conditions IV with the process chamber outer heater set at 300° C. and the process chamber inner heater set at 335° C. over the course of 250 cycles with each cycle including three doses of pivalic acid and one dose of water as follows:

(a) a 0.5-second exposure of water vapor, $H_2O$ (delivered by vapor-draw, while held at a temperature slightly higher than room temperature (about 30° C.), which resulted in a pressure spike of 0.650-0.700 Torr);

(b) a 5-second purge with 5 sccm of nitrogen;

(c) a 0.5-second exposure of pivalic acid, $(CH_3)_3C$—COOH (delivered by vapor-draw heated to and held at 80° C. (uncorrected temperature), which resulted in a pressure spike of 0.930-0.960 Torr) (note: the pivalic acid was used in a flow-through mode without the assistance of a carrier gas);

(d) a 1-second purge with 5 sccm of nitrogen;

(e) a 0.5-second exposure of pivalic acid, $(CH_3)_3C$—COOH (delivered by vapor-draw heated to and held at 80° C. (uncorrected temperature), which resulted in a pressure spike of 0.930-0.960 Torr) (note: the pivalic acid was used in a flow-through mode without the assistance of a carrier gas);

(f) a 1-second purge with 5 sccm of nitrogen;

(g) a 0.5-second exposure of pivalic acid, $(CH_3)_3C$—COOH (delivered by vapor-draw heated to and held at 80° C. (uncorrected temperature), which resulted in a pressure spike of 0.930-0.960 Torr) (note: the pivalic acid was used in a flow-through mode without the assistance of a carrier gas); and (h) a 5-second purge with 5 sccm of nitrogen.

After 250 cycles, 14-20 Å of cobalt were etched from the cobalt coupon placed near the center of the process chamber (heated to about 300° C.) reflecting an etch rate of 0.056-0.080 Å/cycle.

Example 10: Cobalt ALE Under Standard Conditions

In this example, ALE was performed under Etching Conditions III with the process chamber outer heater set at 280° C. and the process chamber inner heater set at 335° C. over the course of 250 cycles with each cycle including three doses of pivalic acid (with differing pre-heated temperatures) and three doses of water as follows:

(a) a 0.5-second exposure of water vapor, $H_2O$ (delivered by vapor-draw, while held at a temperature slightly higher than room temperature (about 30° C.), which resulted in a pressure spike of 0.650-0.700 Torr);
(b) a 1-second purge with 5 sccm of nitrogen;
(c) a 0.5-second exposure of water vapor, $H_2O$ (delivered by vapor-draw, while held at a temperature slightly higher than room temperature (about 30° C.), which resulted in a pressure spike of 0.650-0.700 Torr);
(d) a 1-second purge with 5 sccm of nitrogen;
(e) a 0.5-second exposure of water vapor, $H_2O$ (delivered by vapor-draw, while held at a temperature slightly higher than room temperature (about 30° C.), which resulted in a pressure spike of 0.650-0.700 Torr);
(f) a 5-second purge with 5 sccm of nitrogen;
(g) a 0.5-second exposure of pivalic acid, $(CH_3)_3C$—COOH (delivered by vapor-draw heated to and held at 80, 85, or 90° C., respectively (uncorrected temperature), which resulted in a pressure spike (note: the pivalic acid was used in a flow-through mode without the assistance of a carrier gas);
(h) a 1-second purge with 5 sccm of nitrogen;
(i) a 0.5-second exposure of pivalic acid, $(CH_3)_3C$—COOH (delivered by vapor-draw heated to and held at 80, 85, or 90° C., respectively (uncorrected temperature), which resulted in a pressure spike (note: the pivalic acid was used in a flow-through mode without the assistance of a carrier gas);
(j) a 1-second purge with 5 sccm of nitrogen;
(k) a 0.5-second exposure of pivalic acid, $(CH_3)_3C$—COOH (delivered by vapor-draw heated to and held at 80, 85, or 90° C., respectively (uncorrected temperature), which resulted in a pressure spike (note: the pivalic acid was used in a flow-through mode without the assistance of a carrier gas); and
(l) a 5-second purge with 5 sccm of nitrogen.

After 250 cycles with the pivalic acid having been heated to 80° C., (i) 34 Å of cobalt was etched from the cobalt coupon placed near the reactor inlet of the process chamber (heated to about 300° C.) reflecting an etch rate of 0.136 Å/cycle, (ii) 40 Å of cobalt was etched from the cobalt coupon placed near the reactor center of the process chamber (heated to about 335° C.) reflecting an etch rate of 0.160 Å/cycle and (iii) 40 Å of cobalt was etched from the cobalt coupon placed near the reactor outlet of the process chamber (heated to about 300° C.) reflecting an etch rate of 0.160 Å/cycle.

After 250 cycles with the pivalic acid having been heated to 85° C., (i) 40 Å of cobalt was etched from the cobalt coupon placed near the reactor inlet of the process chamber (heated to about 300° C.) reflecting an etch rate of 0.160 Å/cycle, (ii) 40 Å of cobalt was etched from the cobalt coupon placed near the reactor center of the process chamber (heated to about 335° C.) reflecting an etch rate of 0.160 Å/cycle and (iii) 51 Å of cobalt was etched from the cobalt coupon placed near the reactor outlet of the process chamber (heated to about 300° C.) reflecting an etch rate of 0.204 Å/cycle.

After 250 cycles with the pivalic acid having been heated to 90° C., (i) 37 Å of cobalt was etched from the cobalt coupon placed near the reactor inlet of the process chamber (heated to about 300° C.) reflecting an etch rate of 0.148 Å/cycle, (ii) 45 Å of cobalt was etched from the cobalt coupon placed near the reactor center of the process chamber (heated to about 335° C.) reflecting an etch rate of 0.180 Å/cycle and (iii) 51 Å of cobalt was etched from the cobalt coupon placed near the reactor outlet of the process chamber (heated to about 300° C.) reflecting an etch rate of 0.204 Å/cycle.

Example 11: Cobalt Heat-Treatment Under Standard Conditions

In this example, ALE was performed under Etching Conditions VII with the process chamber outer heater set at 280° C. and the process chamber inner heater set at 335° C. over the course of 250 cycles with each cycle including two doses of water as follows:

(a) a 0.5-second exposure of water vapor, $H_2O$ (delivered by vapor-draw, while held at a temperature slightly higher than room temperature (about 30° C.), which resulted in a pressure spike of 0.650-0.700 Torr);
(b) a 5-second purge with 5 sccm of nitrogen;
(c) a 0.5-second exposure of water vapor, $H_2O$ (delivered by vapor-draw, while held at a temperature slightly higher than room temperature (about 30° C.), which resulted in a pressure spike of 0.650-0.700 Torr); and
(d) a 30-second purge with 5 sccm of nitrogen.

After 250 cycles, 0 Å of cobalt were etched from the cobalt coupon placed near the center of the process chamber (heated to about 335° C.).

Example 12: Tungsten, Copper, Cobalt, Polished Molybdenum and Non-Polished Molybdenum ALE Under Standard Conditions In this example, ALE was performed under Etching Conditions VIII with the process chamber outer heater set at 280° C. and the process chamber inner heater set at 335° C. over the course of 1,000 cycles with each cycle including three doses of pivalic acid (pre-heated to 85° C.) and one dose of water as follows:

(a) a 0.5-second exposure of water vapor, $H_2O$ (delivered by vapor-draw, while held at a temperature slightly higher than room temperature (about 30° C.), which resulted in a pressure spike of 0.650-0.700 Torr);
(b) a 6-second purge with 5 sccm of nitrogen;
(c) a 0.5-second exposure of pivalic acid, $(CH_3)_3C$—COOH (delivered by vapor-draw heated to and held at 85° C. (uncorrected temperature), which resulted in a pressure spike (note: the pivalic acid was used in a flow-through mode without the assistance of a carrier gas);
(d) a 1-second purge with 5 sccm of nitrogen;
(e) a 0.5-second exposure of pivalic acid, $(CH_3)_3C$—COOH (delivered by vapor-draw heated to and held at 85° C. (uncorrected temperature), which resulted in a pressure spike (note: the pivalic acid was used in a flow-through mode without the assistance of a carrier gas);
(f) a 1-second purge with 5 sccm of nitrogen;
(g) a 0.5-second exposure of pivalic acid, $(CH_3)_3C$—COOH (delivered by vapor-draw heated to and held at 85° C. (uncorrected temperature), which resulted in a pressure spike (note: the pivalic acid was used in a flow-through mode without the assistance of a carrier gas); and
(h) a 5-second purge with 5 sccm of nitrogen.

After 1,000 cycles with the pivalic acid having been heated to 85° C., (i) 11 Å of tungsten was etched from the tungsten coupon placed near the center of the reactor of the process chamber (heated to about 335° C.) representing an etch rate of 0.011 Å/cycle, (ii) 40 Å of molybdenum was etched from the polished molybdenum coupon placed near the center of the reactor of the process chamber (heated to about 335° C.) representing an etch rate of 0.040 Å/cycle, (iii) 85 Å of molybdenum was etched from the non-polished molybdenum coupon placed near the center of the reactor of the process chamber (heated to about 335° C.) representing an etch rate of 0.085 Å/cycle, (iv) 101-104 Å of cobalt was etched from the cobalt coupon placed near the center of the reactor of the process chamber (heated to about 335° C.) representing an etch rate of 0.1 Å/cycle and (v) 220-1548 Å of copper was etched from the copper coupon placed near the center of the reactor of the process chamber (heated to about 335° C.) representing an etch rate of 0.220-1.548 Å/cycle.

Example 13: Tungsten, Copper, Cobalt, Polished Molybdenum and Non-Polished Molybdenum ALE Under Standard Conditions In this example, ALE was performed under Etching Conditions IX with the process chamber outer heater set at 280° C. and the process chamber inner heater set at 335° C. over the course of 250 cycles with each cycle including three doses of pivalic acid (pre-heated to 60° C., used in a trapped mode and delivered with nitrogen carrier gas) and two doses of water as follows:

(a) a 0.5-second exposure of water vapor, $H_2O$ (delivered by vapor-draw, while held at a temperature slightly higher than room temperature (about 30° C.), which resulted in a pressure spike of 0.650-0.700 Torr);
(b) a 1-second purge with 5 sccm of nitrogen;
(c) a 0.5-second exposure of water vapor, $H_2O$ (delivered by vapor-draw, while held at a temperature slightly higher than room temperature (about 30° C.), which resulted in a pressure spike of 0.650-0.700 Torr);
(d) a 1-second purge with 5 sccm of nitrogen;
(e) a 0.5-second exposure of pivalic acid, $(CH_3)_3C$—COOH (delivered with assistance of $N_2$, while held at 60° C. (uncorrected temperature), which resulted in a pressure spike of 0.930-0.960 Torr); (Note: the deposition chamber outlet had been closed prior to the delivery of pivalic acid, so as to keep it trapped in the chamber. Following this pulse of pivalic acid, the reactor outlet was kept closed for an additional 1 second, to keep the pivalic acid trapped in the reactor (to maximize its impact), the reactor's vacuum was then opened, to evacuate the gasses from the reactor);
(f) a 0.1-second purge with 5 sccm of nitrogen;
(g) a 0.5-second exposure of pivalic acid, $(CH_3)_3C$—COOH (delivered with assistance of $N_2$, while held at 60° C. (uncorrected temperature), which resulted in a pressure spike of 0.930-0.960 Torr); (Note: the deposition chamber outlet had been closed prior to the delivery of pivalic acid, so as to keep it trapped in the chamber. Following this pulse of pivalic acid, the reactor outlet was kept closed for an additional 1 second, to keep the pivalic acid trapped in the reactor (to maximize its impact), the reactor's vacuum was then opened, to evacuate the gasses from the reactor);
(h) a 0.1-second purge with 5 sccm of nitrogen;
(i) a 0.5-second exposure of pivalic acid, $(CH_3)_3C$—COOH (delivered with assistance of $N_2$, while held at 60° C. (uncorrected temperature), which resulted in a pressure spike of 0.930-0.960 Torr); (Note: the deposition chamber outlet had been closed prior to the delivery of pivalic acid, so as to keep it trapped in the chamber. Following this pulse of pivalic acid, the reactor outlet was kept closed for an additional 1 second, to keep the pivalic acid trapped in the reactor (to maximize its impact), the reactor's vacuum was then opened, to evacuate the gasses from the reactor); and
(j) a 5-second purge with 5 sccm of nitrogen.

After 250 cycles with the pivalic acid having been heated to 60° C., (i) 53 Å of tungsten was etched from the tungsten coupon placed near the center of the reactor of the process chamber (heated to about 335° C.) representing an etch rate of 0.212 Å/cycle, (ii) 65 Å of molybdenum was etched from the polished molybdenum coupon placed near the center of the reactor of the process chamber (heated to about 335° C.) representing an etch rate of 0.260 Å/cycle, (iii) 100 Å of molybdenum was etched from the non-polished molybdenum coupon placed near the center of the reactor of the process chamber (heated to about 335° C.) representing an etch rate of 0.400 Å/cycle, (iv) 103-113 Å of cobalt was etched from the cobalt coupon placed near the center of the reactor of the process chamber (heated to about 335° C.) representing an etch rate of 0.41-0.45 Å/cycle and (v) 965 Å of copper was etched from the copper coupon placed near the center of the reactor of the process chamber (heated to about 335° C.) representing an etch rate of 3.86 Å/cycle.

Example 14: Copper ALE Under Standard Conditions

In this example, ALE was performed under Etching Conditions X with the process chamber outer heater set at 280° C. and the process chamber inner heater set at 335° C. over the course of 250, 175, 320, 350 or 700 cycles with each cycle including three doses of pivalic acid (pre-heated to 60° C., used in a trapped mode and delivered with nitrogen carrier gas) and one dose of water as follows:

(a) a 0.5-second exposure of water vapor, $H_2O$ (delivered by vapor-draw, while held at a temperature slightly higher than room temperature (about 30° C.), which resulted in a pressure spike of 0.650-0.700 Torr);
(b) a 1-second purge with 5 sccm of nitrogen;
(c) a 0.5-second exposure of pivalic acid, $(CH_3)_3C$—COOH (delivered with assistance of $N_2$, while held at 60° C. (uncorrected temperature), which resulted in a pressure spike of 0.930-0.960 Torr); (Note: the deposition chamber outlet had been closed prior to the delivery of pivalic acid, so as to keep it trapped in the chamber. Following this pulse of pivalic acid, the reactor outlet was kept closed for an additional 1 second, to keep the pivalic acid trapped in the reactor (to maximize its impact), the reactor's vacuum was then opened, to evacuate the gasses from the reactor);
(d) a 0.1-second purge with 5 sccm of nitrogen;
(e) a 0.5-second exposure of pivalic acid, $(CH_3)_3C$—COOH (delivered with assistance of $N_2$, while held at 60° C. (uncorrected temperature), which resulted in a pressure spike of 0.930-0.960 Torr); (Note: the deposition chamber outlet had been closed prior to the delivery of pivalic acid, so as to keep it trapped in the chamber. Following this pulse of pivalic acid, the reactor outlet was kept closed for an additional 1 second, to keep the pivalic acid trapped in the reactor (to maximize its impact), the reactor's vacuum was then opened, to evacuate the gasses from the reactor);

(f) a 0.1-second purge with 5 sccm of nitrogen;

(g) a 0.5-second exposure of pivalic acid, $(CH_3)_3C—COOH$ (delivered with assistance of $N_2$, while held at 60° C. (uncorrected temperature), which resulted in a pressure spike of 0.930-0.960 Torr); (Note: the deposition chamber outlet had been closed prior to the delivery of pivalic acid, so as to keep it trapped in the chamber. Following this pulse of pivalic acid, the reactor outlet was kept closed for an additional 1 second, to keep the pivalic acid trapped in the reactor (to maximize its impact), the reactor's vacuum was then opened, to evacuate the gasses from the reactor); and (h) a 5-second purge with 5 sccm of nitrogen.

The RMS of the copper samples for this example before any etching treatment was 0.73 nm (roughness) as measured by AFM.

After 250 cycles and with the pivalic acid was heated to 60° C., 130 Å of copper was etched from the copper coupon placed near the center of the reactor of the process chamber (heated to about 200° C.) representing an etch rate of 0.52 Å/cycle.

After 175 cycles and with the pivalic acid was heated to 60° C., (i) 30-90 Å of copper was etched from the copper coupon placed near the center of the reactor of the process chamber (heated to about 180° C.) representing an etch rate of 0.17-0.52 Å/cycle, (ii) 13-67 Å of copper was etched from the copper coupon placed near the center of the reactor of the process chamber (heated to about 160° C.) representing an etch rate of 0.07-0.38 Å/cycle, (iii) 37-41 Å of copper was etched from the copper coupon placed near the center of the reactor of the process chamber (heated to about 140° C.) representing an etch rate of 0.21-0.23 Å/cycle, (iv) 18-37 Å of copper was etched from the copper coupon placed near the center of the reactor of the process chamber (heated to about 130° C.) representing an etch rate of 0.11-0.21 Å/cycle and (v) 21-25 Å of copper was etched from the copper coupon placed near the center of the reactor of the process chamber (heated to about 120° C.) representing an etch rate of 0.12-0.14 Å/cycle.

After 350 cycles and with the pivalic acid was heated to 60° C., 25-45 Å of copper was etched from the copper coupon placed near the center of the reactor of the process chamber (heated to about 120° C.) representing an etch rate of 0.07-0.12 Å/cycle and after this treatment, the copper film had an RMS of 2.41 nm (roughness) as measured by AFM, some film pitting could be found after the etching treatment.

After 700 cycles and with the pivalic acid was heated to 60° C., 52-60 Å of copper was etched from the copper coupon placed near the center of the reactor of the process chamber (heated to about 120° C.) representing an etch rate of 0.08-0.09 Å/cycle and after this treatment, the copper film had an RMS of 10.79 nm (roughness) as measured by AFM, film pitting and island formation was very prevalent after this etching protocol.

After 320 cycles and with the pivalic acid was heated to 60° C., 11-23 Å of copper was etched from the copper coupon placed near the center of the reactor of the process chamber (heated to about 110° C.) an etch rate of 0.034-0.07 Å/cycle and after this treatment, the copper film had an RMS of 1.67 nm (roughness) as measured by AFM, film pitting was almost impossible to find after the etching treatment.

The above results are summarized in Table 2. Table 2 also shows that the copper films etched at 200° C., 180° C., and 160° C. became insulating while the copper films etched at temperatures equal to or lower than 140° C. remained electrically conducting.

TABLE 2

| Etching Temp. (° C.) | Cycle No. | Total Cu Etched (Å) | Fraction of Cu Film Remaining | Etch Rate (Å/cycle) | Cu Film Resistivity |
|---|---|---|---|---|---|
| 200 | 250 | 130 | 13% | 0.52 | Insulating |
| 180 | 175 | 30-90 | 40-80% | 0.17-0.52 | Insulating |
| 160 | 175 | 13-67 | 55-91% | 0.07-0.38 | Insulating |
| 140 | 175 | 37-41 | 73-75% | 0.21-0.23 | 8-33 μΩ · cm |
| 130 | 175 | 18-37 | 75-88% | 0.11-0.21 | 8.7-9.4 μΩ · cm |
| 120 | 175 | 21-25 | 83-86% | 0.12-0.14 | 7.0-7.8 μΩ · cm |
| 120 | 350 | 25-45 | 70-83% | 0.07-0.12 | 7.2-7.4 μΩ · cm |
| 120 | 700 | 52-60 | 60-65% | 0.08-0.09 | 26-43 μΩ · cm |
| 110 | 320 | 11-23 | 85-93% | 0.034-0.07 | 7.2-7.9 μΩ · cm |

Example 15: Copper Heat-Treated Under Standard Conditions

In this example, ALE was performed under Etching Conditions XI with the process chamber outer heater sand the process chamber inner heater each set at the same temperature (either 120° C. or 170° C.).

In one run, the copper sample was heated to 3.5 hours at 120° C. After this treatment, extremely few pinholes, and no tall island formation were observed, but the surface morphology became rougher; the copper film had an RMS of 1.49 nm (roughness) as measured by AFM. No copper was etched.

In another run, the copper sample was heated to 70 minutes at 170° C. After this treatment, numerous pinholes and numerous freshly formed tall island were observed. No copper was etched.

Example 16: Copper Heat-Treated Under Standard Conditions

In this example, ALE was performed under Etching Conditions XII with the process chamber outer heater set at 120° C. and the process chamber inner heater set at 120° C. over the course of 350 cycles with each cycle including one dose of water as follows:

(a) a 0.5-second exposure of water vapor, $H_2O$ (delivered by vapor-draw, while held at a temperature slightly higher than room temperature (about 30° C.), which resulted in a pressure spike of 0.650-0.700 Torr); and (b) a 36.9-second purge with 5 sccm of nitrogen.

After 350 cycles, no pinholes and no tall island formation were observed, but the surface morphology became rougher; the copper film had an RMS of 2.04 nm (roughness) as measured by AFM. No copper was etched.

Example 17: Copper Heat-Treated Under Standard Conditions

In this example, ALE was performed under Etching Conditions XII with the process chamber outer heater set at 120° C. and the process chamber inner heater set at 120° C. over the course of 350 cycles with each cycle including one dose of pivalic acid as follows:

(a) a 0.5-second exposure of pivalic acid, $(CH_3)_3C—COOH$ (delivered with assistance of $N_2$, while held at 60° C. (uncorrected temperature), which resulted in a pressure spike of 0.930-0.960 Torr); (Note: the deposition chamber outlet had been closed prior to the delivery of pivalic acid, so as to keep it trapped in the chamber. Following this pulse of pivalic acid, the reactor outlet was kept closed for an additional 1 second, to keep the pivalic acid trapped in the reactor (to maximize its impact), the reactor's vacuum was then opened, to evacuate the gasses from the reactor);

(b) a 0.1-second purge with 5 sccm of nitrogen;

(c) a 0.5-second exposure of pivalic acid, $(CH_3)_3C$—COOH (delivered with assistance of $N_2$, while held at 60° C. (uncorrected temperature), which resulted in a pressure spike of 0.930-0.960 Torr); (Note: the deposition chamber outlet had been closed prior to the delivery of pivalic acid, so as to keep it trapped in the chamber. Following this pulse of pivalic acid, the reactor outlet was kept closed for an additional 1 second, to keep the pivalic acid trapped in the reactor (to maximize its impact), the reactor's vacuum was then opened, to evacuate the gasses from the reactor);

(d) a 0.1-second purge with 5 sccm of nitrogen;

(e) a 0.5-second exposure of pivalic acid, $(CH_3)_3C$—COOH (delivered with assistance of $N_2$, while held at 60° C. (uncorrected temperature), which resulted in a pressure spike of 0.930-0.960 Torr); (Note: the deposition chamber outlet had been closed prior to the delivery of pivalic acid, so as to keep it trapped in the chamber. Following this pulse of pivalic acid, the reactor outlet was kept closed for an additional 1 second, to keep the pivalic acid trapped in the reactor (to maximize its impact), the reactor's vacuum was then opened, to evacuate the gasses from the reactor); and (f) a 5-second purge with 5 sccm of nitrogen.

After 350 cycles, some pinholes but no tall island formation were observed; the copper film had an RMS of 1.54 nm (roughness) as measured by AFM—smoother than a film exposed to pulses of water alone. Between 8 Å and 24 Å of copper was etched.

Example 18: Copper ALE Under Standard Conditions

In this example, ALE was performed under Etching Conditions XIV with the process chamber outer heater set at 140° C. and the process chamber inner heater set at 140° C. over the course of 700, 1750, or 3000 cycles with each cycle including one dose of pivalic acid (pre-heated at 75° C.) and one dose of water as follows:

(a) a 0.5-second exposure of water vapor, $H_2O$ (delivered by vapor-draw, while held at a temperature slightly higher than room temperature (30° C.), which resulted in a pressure spike of 0.650-0.700 Torr);

(b) a 5-second purge with 5 sccm of nitrogen;

(c) a 0.5-second exposure of pivalic acid, $(CH_3)_3C$—COOH (delivered with assistance of $N_2$) and heated to and held at 75° C. (uncorrected temperature) (note: the pivalic acid was used in a flow-through mode without the assistance of a carrier gas); and (d) a 10-second purge with 5 sccm of nitrogen.

The RMS of the copper samples, before any etching treatment, was 0.73 nm (roughness) as measured by AFM.

After 700 cycles, 20-21 Å of copper was etched, the film resistivity was 7.2-7.9 μΩ·cm post-etch. Few pinholes and no tall islands of crystalline copper could be detected. The roughness of the copper film post-etch was 1.255 nm.

After 1750 cycles and an initial base pressure of 0.5 Torrs, (i) 32 Å of copper was etched, the film resistivity was 9 μΩ·cm, and the roughness was 4.8 nm for the coupon near the reactor inlet, (ii) 20-50 Å of copper was etched, the film resistivity was 9-19 μΩ·cm, and the roughness varied from 1.7 to 5.4 nm for the coupon near the reactor center and (iii) 64 Å of copper was etched, the film resistivity was 67 μΩ·cm, and the roughness was 4.3 nm for the coupon near the reactor outlet. Pinholes could be detected, but no tall islands of crystalline copper could be detected on any of the coupons.

After 1750 cycles and an initial base pressure of 0.75 Torrs, (i) 30 Å of copper was etched, the film resistivity was 7.3 μΩ·cm, and the roughness varied from 2.8 to 3.5 nm for the coupon near the reactor inlet, (ii) 58 Å of copper was etched, the film resistivity was 35 μΩ·cm, and the roughness varied from 3.1 to 5.4 nm for the coupon near the reactor center and (iii) 56 Å of copper was etched, the film resistivity was 55 μΩ·cm, and the roughness was 4.5 nm for the coupon near the reactor outlet. Pinholes could be detected, but no tall islands of crystalline copper could be detected on any of the coupons.

After 3000 cycles and an initial base pressure of 0.17 Torrs, (i) 39-44 Å of copper was etched, the film resistivity was 10-11 μΩ·cm, and the roughness was 4.0 nm for the coupon near the reactor inlet, (ii) 82 Å of copper was etched, the copper film became insulating, and the roughness was 3.3 nm for the coupon near the reactor center and (iii) 75 Å of copper was etched, the copper film became insulating, and the roughness was 3.8 nm for the coupon near the reactor outlet. Pinholes could be detected, but no tall islands of crystalline copper could be detected on any of the coupons.

After 1750 cycles of only a pulse of water, and an initial base pressure of 0.18 Torrs, (i) no copper was etched, and the roughness was 3.15 nm for the coupon near the reactor inlet, (ii) no copper was etched, and the roughness was 1.8 nm for the coupon near the reactor middle and (iii) no copper was etched, and the roughness was 3.9 nm for the coupon near the reactor outlet. Pinholes could be detected, and tall islands of crystalline copper could also be detected on any of the coupons.

The above data for Example 18 is summarized in Table 3 and Table 4.

TABLE 3

| Cycle No. | Reactor Base Pressure at Etch Start | Total Cu Etched (Å) | Fraction of Cu film remaining | Etch rate (Å/cycle) | Cu Film Resistivity |
|---|---|---|---|---|---|
| 700 | 0.6 | 20-21 | 86-87% | 0.029-0.03 | 7.2-7.9 μΩ · cm |
| 1750 | 1.1 | 24-41 | 73-84% | 0.014-0.023 | 10-14 μΩ · cm |
| 1750 | 0.5 | 32-64 | 57-79% | 0.012-0.036 | 9-67 μΩ · cm |
| 1750 | 0.75 | 30-56 | 62-80% | 0.017-0.033 | 7-55 μΩ · cm |
| 3000 | 0.17 | 39-82 | 45-74% | 0.014-0.027 | 10 μΩ · cm to insulating |
| 1750 ($H_2O$ only) | 0.25 | none | 100% | none | n/a |

TABLE 4

| Cycle No. | Reactor Base Pressure at Etch Start | Total Cu Etched (Å) | RMS | Presence of Pinholes | Presence of Tall Cu Islands |
|---|---|---|---|---|---|
| 700 | 0.6 | 20-21 | 1.255 | Yes | None |
| 1750 | 1.1 | 24-41 | 9.7 nm | Yes | Yes |
| 1750 | 0.5 | 32-64 | 1.7-5.3 nm | Yes | None |

TABLE 4-continued

| Cycle No. | Reactor Base Pressure at Etch Start | Total Cu Etched (Å) | RMS | Presence of Pinholes | Presence of Tall Cu Islands |
|---|---|---|---|---|---|
| 1750 | 0.75 | 30-56 | 2.9-5.4 nm | Yes | None |
| 3000 | 0.17 | 39-82 | 3.3-4 nm | Yes | None |
| 1750 ($H_2O$ only) | 0.25 | none | 2-4 nm | Yes | Yes |

As noted above, the experiments for Etching Conditions XV through XVII and Examples 19 through 24 were performed in an ALD system with a funnel lid. This ALD system has capability to accommodate up to 12" diameter wafer sizes. This ALD system has a heated pedestal upon which the wafer is disposed. For each experiment, a 44 mm×44 mm test substrate was disposed on a 300 mm carrier wafer. The test substrate was prepared by physical vapor deposition (PVD) of 250 Å titanium atop a 200 mm wafer, followed by PVD of 500 Å copper atop the titanium layer. The 200 mm wafer was then cleaved into 44 mm×44 mm test substrates. Pivalic acid was obtained from Millipore Sigma. The normal temperature of pivalic acid in Etching Condition XV is 50° C. The normal temperature of pivalic acid in Etching Condition XVI through XVII is 60° C. For each experiment, the pedestal was heated to a temperature 25 degrees C. higher than the intended sample temperature to accommodate for a temperature gradient across the carrier wafer. Throughout the entire process, argon purge flows of 140 sccm, 140 sccm, and 200 sccm were continuously run to protect sensitive interior parts of the chamber.

Example 19: Copper ALE Under Standard Conditions

In this example, ALE was performed under Etching Conditions XV with the process chamber pedestal heater set at 225° C. (corresponding to an estimated sample temperature of 200° C.) and the process chamber lid heaters set at 130° C. over the course of 100 cycles with each cycle including one dose of pivalic acid (pre-heated at 50° C.) as follows:

(a) a 5-second exposure of pivalic acid, $(CH_3)_3C—COOH$ (delivered with assistance of 100 sccm of argon as a carrier gas), while the chamber pressure was maintained at 2.0 Torr; and (b) a purge of about 75 seconds with about 1000-1500 sccm of argon.

The RMS roughness of the copper sample before any etching treatment was 1.3 nm (roughness) as measured by AFM. Pinholes could be detected, but no tall islands of crystalline copper could be detected on the copper samples before any etching treatment. The typical resistivity across the test substrate surface was 3.3 μΩ·cm prior to etch.

After 100 cycles, 3-7 Å of copper was etched, the film resistivity was 3.6 μΩ·cm post-etch.

Example 20: Copper ALE Under Standard Conditions

In this example, ALE was performed under Etching Conditions XVI with the process chamber pedestal heater set at 165° C., 245° C., or 325° C. (corresponding to an estimated sample temperature of 140° C., 220° C., or 300° C.) and the process chamber lid heaters set at 130° C. over the course of 200 cycles with each cycle including one dose of pivalic acid (pre-heated at 60° C.) and one dose of water co-flowed with oxygen as follows:

(a) a 2-second exposure of water vapor, $H_2O$ (delivered by vapor-draw, while held at room temperature (25° C.), and aided by a 100 sccm Ar flow through the line from which the $H_2O$ was dosed, plus a 200 sccm Ar flow through the manifold through which $H_2O$ reached the chamber) and oxygen, $O_2$ (delivered at 800 sccm), while the chamber pressure was maintained at 2.0 Torr;

(b) a 10-second purge with 1500 sccm of argon;

(c) a 5-second exposure of pivalic acid, $(CH_3)_3C—COOH$ (delivered with assistance of 100 sccm of argon as a carrier gas), while the chamber pressure was maintained at 2.0 Torr; and (d) a 60-second purge with 1500 sccm of argon.

The RMS roughness of the copper samples before any etching treatment was 1.3 nm (roughness) as measured by AFM. Pinholes could be detected, but no tall islands of crystalline copper could be detected on the copper samples before any etching treatment. The typical resistivity across the test substrate surface was 3.3 μΩ·cm prior to etch.

After 200 cycles with the process chamber pedestal heater set at 165° C. (corresponding to an estimated sample temperature of 140° C.), 10-14 Å of copper was etched, the film resistivity was 3.6 μΩ·cm post-etch. Pinholes could be detected, but no tall islands of crystalline copper could be detected. The roughness of the copper film post-etch was 1.5 nm.

After 200 cycles with the process chamber pedestal heater set at 245° C. (corresponding to an estimated sample temperature of 220° C.), 95-99 Å of copper was etched, the film resistivity was 5.1 μΩ·cm post-etch. Pinholes could be detected, and some tall islands of crystalline copper could be detected. The roughness of the copper film post-etch was 10.6 nm.

After 200 cycles with the process chamber pedestal heater set at 325° C. (corresponding to an estimated sample temperature of 300° C.), 202-206 Å of copper was etched, the film resistivity was 198 μΩ·cm post-etch. Tall islands of crystalline copper were the dominant features. The roughness of the copper film post-etch was 48.2 nm.

Example 21: Copper ALE Under Standard Conditions

In this example, ALE was performed under Etching Conditions XVI with the process chamber pedestal heater set at 195° C. (corresponding to an estimated sample temperature of 170° C.) and the process chamber lid heaters set at 130° C. over the course of 100 cycles with each cycle including one dose of pivalic acid (pre-heated at 60° C.) and one dose of water co-flowed with oxygen as follows:

(a) a 2-second exposure of water vapor, $H_2O$ (delivered by vapor-draw, while held at room temperature (25° C.)) and oxygen, $O_2$ (delivered at 0 (zero), 200, 400, 600, or 800 sccm), while the chamber pressure was maintained at 2.0 Torr;

(b) a 10-second purge with 1500 sccm of argon;

(c) a 5-second exposure of pivalic acid, $(CH_3)_3C—COOH$ (delivered with assistance of 100 sccm of argon as a carrier gas), while the chamber pressure was maintained at 2.0 Torr; and (d) a 60-second purge with 1500 sccm of argon.

The RMS roughness of the copper samples before any etching treatment was 1.3 nm (roughness) as measured by AFM. Pinholes could be detected, but no tall islands of crystalline copper could be detected on the copper samples before any etching treatment. The typical resistivity across the test substrate surface was 3.3 μΩ·cm prior to etch.

After 100 cycles with a 0 (zero) sccm $O_2$ co-flow, 8-12 Å of copper was etched, the film resistivity was 3.6 μΩ·cm post-etch.

After 100 cycles with a 200 sccm $O_2$ co-flow, 8-12 Å of copper was etched, the film resistivity was 3.7 μΩ·cm post-etch.

After 100 cycles with a 400 sccm $O_2$ co-flow, 11-15 Å of copper was etched, the film resistivity was 3.6 μΩ·cm post-etch.

After 100 cycles with a 800 sccm $O_2$ co-flow, 12-16 Å of copper was etched, the film resistivity was 3.5 μΩ·cm post-etch. Pinholes could be detected, but no tall islands of crystalline copper could be detected. The roughness of the copper film post-etch was 1.6 nm.

Example 22: Copper ALE Under Standard Conditions

In this example, ALE was performed under Etching Conditions XVII with the process chamber pedestal heater set at 195° C. (corresponding to an estimated sample temperature of 170° C.) and the process chamber lid heaters set at 130° C. over the course of 100 cycles with each cycle including one dose of pivalic acid (pre-heated at 60° C.) and one, two, or three doses of water co-flowed with oxygen as follows:

(a) one, two, or three consecutive 2-second exposures of oxygen, $O_2$ (delivered at 800 sccm) dosed simultaneously with or without water vapor, $H_2O$ (delivered by vapor-draw, while held at room temperature (25° C.)), with each consecutive dose separated by a 5-second purge with 800 sccm of argon, while the chamber pressure was maintained at 2.0 Torr;

(b) a 10-second purge with 1500 sccm of argon;

(c) a 5-second exposure of pivalic acid, $(CH_3)_3C—COOH$ (delivered with assistance of 100 sccm of argon as a carrier gas), while the chamber pressure was maintained at 2.0 Torr; and (d) a 60-second purge with 1500 sccm of argon.

The RMS roughness of the copper samples before any etching treatment was 1.3 nm (roughness) as measured by AFM. Pinholes could be detected, but no tall islands of crystalline copper could be detected on the copper samples before any etching treatment. The typical resistivity across the test substrate surface was 3.3 μΩ·cm prior to etch.

After 100 cycles with one dose of 800 sccm $O_2$ per cycle in step (a), 8-12 Å of copper was etched, the film resistivity was 3.7 μΩ·cm post-etch.

After 100 cycles with one dose of $H_2O$ vapor+800 sccm $O_2$ per cycle in step (a), 12-16 Å of copper was etched, the film resistivity was 3.5 μΩ·cm post-etch. Pinholes could be detected, but no tall islands of crystalline copper could be detected. The roughness of the copper film post-etch was 1.6 nm.

After 100 cycles with two doses of $H_2O$ vapor+800 sccm $O_2$ per cycle in step (a), 13-17 Å of copper was etched, the film resistivity was 3.5 μΩ·cm post-etch.

After 100 cycles with three doses of $H_2O$ vapor+800 sccm $O_2$ per cycle in step (a), 13-17 Å of copper was etched, the film resistivity was 3.5 μΩ·cm post-etch.

Example 23: Copper ALE Under Standard Conditions

In this example, ALE was performed under Etching Conditions XVI with the process chamber pedestal heater set at 195° C. (corresponding to an estimated sample temperature of 170° C.) and the process chamber lid heaters set at 130° C. over the course of 100 cycles with each cycle including one dose of pivalic acid (pre-heated at 60° C.) and one dose of water co-flowed with 800 sccm oxygen as follows:

(a) a 2-second exposure of water vapor, $H_2O$ (delivered by vapor-draw, while held at room temperature (25° C.)) and oxygen, $O_2$ (delivered at 800 sccm), while the chamber pressure was maintained at 1.0, 2.0, or 4.0 Torr;

(b) a 10-second purge with 1500 sccm of argon;

(c) a 5-second exposure of pivalic acid, $(CH_3)_3C—COOH$ (delivered with assistance of 100 sccm of argon as a carrier gas), while the chamber pressure was maintained at 1.0, 2.0, or 4.0 Torr; and (d) a 60-second purge with 1500 sccm of argon.

The RMS roughness of the copper samples before any etching treatment was 1.3 nm (roughness) as measured by AFM. Pinholes could be detected, but no tall islands of crystalline copper could be detected on the copper samples before any etching treatment. The typical resistivity across the test substrate surface was 3.3 μΩ·cm prior to etch.

After 100 cycles with the chamber pressure maintained at 1.0 Torr during the $H_2O+O_2$ and pivalic acid doses, 11-15 Å of copper was etched, the film resistivity was 3.5 μΩ·cm post-etch. Pinholes could be detected, and some sparse particles with a width of approx. 40-50 nm could be detected. No tall islands of copper could be detected. The roughness of the copper film post-etch was 1.3 nm.

After 100 cycles with the chamber pressure maintained at 2.0 Torr during the $H_2O+O_2$ and pivalic acid doses, 12-16 Å of copper was etched, the film resistivity was 3.5 μΩ·cm post-etch. Pinholes could be detected, but no tall islands of crystalline copper could be detected. The roughness of the copper film post-etch was 1.6 nm.

After 100 cycles with the chamber pressure maintained at 4.0 Torr during the $H_2O+O_2$ and pivalic acid doses, 7-11 Å of copper was etched, the film resistivity was 3.7 μΩ·cm post-etch. Pinholes could be detected, but no tall islands of crystalline copper could be detected. The roughness of the copper film post-etch was 1.9 nm.

Example 24: Copper ALE Under Standard Conditions

In this example, ALE was performed under Etching Conditions XVII with the process chamber pedestal heater set at 195° C. (corresponding to an estimated sample temperature of 170° C.) and the process chamber lid heaters set at 130° C. over the course of 100 cycles with each cycle including one dose of pivalic acid (pre-heated at 60° C.) and two doses of water co-flowed with oxygen as follows:

(a) two consecutive 2-second exposures of oxygen, $O_2$ (delivered at 800 sccm) dosed simultaneously with water vapor, $H_2O$ (delivered by vapor-draw, while held at room temperature (25° C.)), with each consecutive dose separated by a 5-second purge with 800 sccm of argon, while the chamber pressure was maintained at 2.0 Torr;

(b) a 10-second purge with 1500 sccm of argon;

(c) a 2-second, 4-second, 6-second, 8-second, or 10-second exposure of pivalic acid, $(CH_3)_3C—COOH$ (delivered with assistance of 100 sccm of argon as a carrier gas), while the chamber pressure was maintained at 2.0 Torr; and (d) a 60-second purge with 1500 sccm of argon.

In this example, prior to etch, the copper films had been thinned by chemical-mechanical planarization from the original as-received thickness of about 500 Å to a thickness of about 400 Å. The RMS roughness of the copper samples before any etching treatment was 0.7 nm (roughness) as measured by AFM. Pinholes could be detected, and some sparse particles with a width of approx. 40 nm could be detected prior to etch. No tall islands of copper could be detected prior to etch. The typical resistivity across the test substrate surface was 3.4-3.5 μΩ·cm prior to etch.

After 100 cycles with a 2-second pivalic acid dose, 5-9 Å of copper was etched, the film resistivity was 3.5 μΩ·cm post-etch. Pinholes could be detected, and some sparse small particles of approx. 40-80 nm could be detected. No tall islands of copper could be detected. The roughness of the copper film post-etch was 1.0 nm.

After 100 cycles with a 4-second pivalic acid dose, 7-11 Å of copper was etched, the film resistivity was 3.5 μΩ·cm post-etch. Pinholes could be detected, and some sparse particles with a width of approx. 40-50 nm could be detected. No tall islands of copper could be detected. The roughness of the copper film post-etch was 1.2 nm.

After 100 cycles with a 6-second pivalic acid dose, 14-18 Å of copper was etched, the film resistivity was 3.4 μΩ·cm post-etch. Pinholes and long pits could be detected, and some sparse particles with a width of approx. 40 nm could be detected. No tall islands of copper could be detected. The roughness of the copper film post-etch was 1.3 nm.

After 100 cycles with a 8-second pivalic acid dose, 16-20 Å of copper was etched.

After 100 cycles with a 10-second pivalic acid dose 16-20 Å of copper was etched, the film resistivity was 3.5 μΩ·cm post-etch.

Example 25: Copper ALE Under Standard Conditions

In this example, ALE was performed under Etching Conditions XVIII with the process chamber pedestal heater set at 165° C., 195° C., or 225° C. (corresponding to an estimated sample temperature of 140° C., 170° C., or 200° C.) and the process chamber lid heaters set at 130° C. over the course of 200 cycles with each cycle including one dose of pivalic acid (pre-heated at 60° C.) and three doses of hydrogen peroxide as follows:

(a) three consecutive 2-second exposures of hydrogen peroxide, $H_2O_2$ (delivered by vapor-draw, while held at room temperature (25° C.)), with each consecutive dose separated by a 5-second purge with 800 sccm of argon, while the chamber pressure was maintained at 1.0 Torr;

(b) a 30-second purge with 1500 sccm of argon;

(c) an 8-second exposure of pivalic acid, $(CH_3)_3C$—COOH (delivered with assistance of 100 sccm of argon as a carrier gas), while the chamber pressure was maintained at 1.0 Torr; and (d) a 60-second purge with 1500 sccm of argon.

The RMS roughness of the copper samples before any etching treatment was approximately 0.7 nm (roughness) as measured by AFM. Pinholes could be detected, but no tall islands of crystalline copper could be detected on the copper samples before any etching treatment. The typical resistivity across the test substrate surface was 3.7 μΩ·cm prior to etch.

After 200 cycles with the process chamber pedestal heater set at 165° C. (corresponding to an estimated sample temperature of 140° C.), 4-8 Å of copper was etched, the film resistivity was 3.8 μΩ·cm post-etch. Pinholes and small islands could be detected. The roughness of the copper film post-etch was 1.8 nm.

After 200 cycles with the process chamber pedestal heater set at 195° C. (corresponding to an estimated sample temperature of 170° C.), 10-14 Å of copper was etched, the film resistivity was 3.8 μΩ·cm post-etch. Pinholes could be detected, and the coarsening of copper grains could be detected. The roughness of the copper film post-etch was 2.4 nm.

After 200 cycles with the process chamber pedestal heater set at 225° C. (corresponding to an estimated sample temperature of 200° C.), 13-17 Å of copper was etched, the film resistivity was 4.9 μΩ·cm post-etch.

Example 26: Cobalt ALE Under Standard Conditions

In this example, ALE was performed under Etching Conditions XVIII with the process chamber pedestal heater set at 375° C. (corresponding to an estimated sample temperature of 350° C.) and the process chamber lid heaters set at 130° C. over the course of 180 cycles with each cycle including one dose of pivalic acid (pre-heated at 60° C.) and three doses of hydrogen peroxide as follows:

(a) three consecutive 5-second exposures of hydrogen peroxide, $H_2O_2$ (delivered by vapor-draw, while held at room temperature (25° C.)), with each consecutive dose separated by a 2-second purge with 800 sccm of argon, while the chamber pressure was maintained at 1.0 Torr;

(b) a 30-second purge with 1500 sccm of argon;

(c) a 16-second exposure of pivalic acid, $(CH_3)_3C$—COOH (delivered with assistance of 100 sccm of argon as a carrier gas), while the chamber pressure was maintained at 1.0 Torr; and (d) a 60-second purge with 1500 sccm of argon.

The RMS roughness of an example cobalt sample before any etching treatment was 0.5 nm as measured by AFM. A grainy surface could be detected, but no tall islands of crystalline cobalt could be detected on the cobalt samples before any etching treatment.

The thickness of the cobalt on the sample was 190 Å prior to etch. The resistivity across the test substrate surface was 24.8 μΩ·cm prior to etch.

After 200 cycles, 8-12 Å of cobalt was etched, the film resistivity was 12.8 μΩ·cm post-etch. Pinholes could be detected, but no tall islands of crystalline cobalt could be detected. The roughness of the cobalt film post-etch was 0.9 nm.

Example 27: Copper ALE Under Standard Conditions

In this example, ALE was performed under Etching Conditions XIX with the process chamber pedestal heater set at 165° C. (corresponding to an estimated sample temperature of 140° C.) and the process chamber lid heaters set at 130° C. over the course of 100 cycles with each cycle including one dose of isobutyric acid (pre-heated at 50° C.) and two or four doses of oxygen gas as follows:

(a) two or four consecutive 2-second exposures of oxygen, $O_2$, with each consecutive dose separated by a 5-second purge with 800 sccm of argon, while the chamber pressure was maintained at 4.0 Torr;

(b) a 10-second purge with 1500 sccm of argon;

(c) a 30-second exposure of isobutyric acid, $(CH_3)_2CH$—COOH (delivered with assistance of 100 sccm of argon as a carrier gas), while the chamber pressure was maintained at 4.0 Torr; and (d) a 60-second purge with 1500 sccm of argon.

The RMS roughness of the copper samples before any etching treatment was 0.7 nm (roughness) as measured by AFM. Pinholes could be detected, but no tall islands of crystalline copper could be detected on the copper samples before any etching treatment. The typical resistivity across the test substrate surface was 3.7 μΩ·cm prior to etch.

After 100 cycles with two doses of oxygen per cycle, 104-108 Å of copper was etched, the film resistivity was 5.2 μΩ·cm post-etch.

After 100 cycles with four doses of oxygen per cycle, 89-93 Å of copper was etched, the film resistivity was 5.6 μΩ·cm post-etch.

Example 28: Copper ALE Under Standard Conditions

In this example, ALE was performed under Etching Conditions XX with the process chamber pedestal heater set at 165° C. (corresponding to an estimated sample temperature of 140° C.) and the process chamber lid heaters set at 130° C. over the course of 100 cycles with each cycle including one dose of isobutyric acid (pre-heated at 50° C.) and four doses of water co-flowed with oxygen as follows:

(a) four consecutive 2-second exposures of oxygen, $O_2$ (delivered at 800 sccm) dosed simultaneously with water vapor, $H_2O$ (delivered by vapor-draw, while held at room temperature (25° C.)), with each consecutive dose separated by a 5-second purge with 800 sccm of argon, while the chamber pressure was maintained at 4.0 Torr;

(b) a 10-second purge with 1500 sccm of argon;

(c) an 8-second, 20-second, or 30-second exposure of isobutyric acid, $(CH_3)_2CH$—COOH (delivered with assistance of 100 sccm of argon as a carrier gas), while the chamber pressure was maintained at 4.0 Torr; and (d) a 60-second purge with 1500 sccm of argon.

The RMS roughness of the copper samples before any etching treatment was 0.7 nm (roughness) as measured by AFM. Pinholes could be detected, but no tall islands of crystalline copper could be detected on the copper samples before any etching treatment. The typical resistivity across the test substrate surface was 3.7 μΩ·cm prior to etch.

After 100 cycles with an 8-second isobutyric acid dose, 13-17 Å of copper was etched, the film resistivity was 4.1 μΩ·cm post-etch.

After 100 cycles with a 20-second isobutyric acid dose, 46-50 Å of copper was etched, the film resistivity was 4.8 μΩ·cm post-etch. Pinholes could be detected, but no tall islands of crystalline copper could be detected. The roughness of the copper film post-etch was 1.4 nm.

After 100 cycles with a 30-second isobutyric acid dose, 75-79 Å of copper was etched, the film resistivity was 5.8 μΩ·cm post-etch.

Example 29: Copper ALE Under Standard Conditions

In this example, ALE was performed under Etching Conditions XXI with the process chamber pedestal heater set at 165° C. (corresponding to an estimated sample temperature of 140° C.) and the process chamber lid heaters set at 130° C. over the course of 100 cycles with each cycle including one dose of propionic acid (pre-heated at 40° C.) and two or four doses of oxygen gas as follows:

(a) two or four consecutive 2-second exposures of oxygen, $O_2$, with each consecutive dose separated by a 5-second purge with 800 sccm of argon, while the chamber pressure was maintained at 4.0 Torr;

(b) a 10-second purge with 1500 sccm of argon;

(c) a 30-second exposure of propionic acid, $CH_3CH_2$—COOH (delivered with assistance of 100 sccm of argon as a carrier gas), while the chamber pressure was maintained at 4.0 Torr; and (d) a 60-second purge with 1500 sccm of argon.

The RMS roughness of the copper samples before any etching treatment was 0.7 nm (roughness) as measured by AFM. Pinholes could be detected, but no tall islands of crystalline copper could be detected on the copper samples before any etching treatment. The typical resistivity across the test substrate surface was 3.7 μΩ·cm prior to etch.

After 100 cycles with two doses of oxygen per cycle, 15-19 Å of copper was etched, the film resistivity was 5.4 μΩ·cm post-etch.

After 100 cycles with four doses of oxygen per cycle, 124-128 Å of copper was etched, the film resistivity was 7.2 μΩ·cm post-etch.

Example 30: Copper ALE Under Standard Conditions

In this example, ALE was performed under Etching Conditions XXII with the process chamber pedestal heater set at 165° C. (corresponding to an estimated sample temperature of 140° C.) and the process chamber lid heaters set at 130° C. over the course of 100 cycles with each cycle including one dose of propionic acid (pre-heated at 40° C.) and two doses of water co-flowed with oxygen as follows:

(a) two consecutive 2-second exposures of oxygen, $O_2$ (delivered at 800 sccm) dosed simultaneously with water vapor, $H_2O$ (delivered by vapor-draw, while held at room temperature (25° C.)), with each consecutive dose separated by a 5-second purge with 800 sccm of argon, while the chamber pressure was maintained at 4.0 Torr;

(b) a 10-second purge with 1500 sccm of argon;

(c) a 4-second, 12-second, 20-second, or 30-second exposure of propionic acid, $CH_3CH_2$—COOH (delivered with assistance of 100 sccm of argon as a carrier gas), while the chamber pressure was maintained at 4.0 Torr; and (d) a 60-second purge with 1500 sccm of argon.

The RMS roughness of the copper samples before any etching treatment was 0.7 nm (roughness) as measured by AFM. Pinholes could be detected, but no tall islands of crystalline copper could be detected on the copper samples before any etching treatment. The typical resistivity across the test substrate surface was 3.7 μΩ·cm prior to etch.

After 100 cycles with a 4-second propionic acid dose, 15-19 Å of copper was etched, the film resistivity was 4.1 μΩ·cm post-etch. Pinholes could be detected, but no tall islands of crystalline copper could be detected. The roughness of the copper film post-etch was 1.4 nm.

After 100 cycles with a 12-second propionic acid dose, 44-48 Å of copper was etched, the film resistivity was 4.8 μΩ·cm post-etch. Pinholes could be detected, but no tall islands of crystalline copper could be detected. The roughness of the copper film post-etch was 2.1 nm.

After 100 cycles with a 20-second propionic acid dose, 67-71 Å of copper was etched, the film resistivity was 5.6 μΩ·cm post-etch.

After 100 cycles with a 30-second propionic acid dose, 81-85 Å of copper was etched, the film resistivity was 5.4 μΩ·cm post-etch.

Summary

It has been demonstrated that metals like Cu, Co, Mo, and W can be etched in the temperature range of about 100° C. to less than 400° C. A halogen-free organic acid alone may induce some, but limited, etching. This may be attributed to the removal of a native oxide layer on the metal surface.

Etching of copper at temperatures at or below 200° C. is demonstrated by cycling pivalic acid, isobutyric acid, or propionic acid with an oxidant. The oxidant may be water, oxygen, water co-flowed with oxygen, or a different oxidizing and hydroxylating agent such as hydrogen peroxide. The oxidant may be chosen to modify the etch behavior, such as to improve etch selectivity. After etching, the films are only slightly rougher than before etch, and the film resistivity is similar the resistivity before etch.

Cycling pivalic acid, isobutyric acid, or propionic acid with water, oxygen, water co-flowed with oxygen, or hydrogen peroxide, has been demonstrated as effective vapor-phase etch processes for metals. This is performed without the use of halogens or halogenated chemicals.

Although the disclosed and claimed subject matter has been described and illustrated with a certain degree of particularity, it is understood that the disclosure has been made only by way of example, and that numerous changes in the conditions and order of steps can be resorted to by those skilled in the art without departing from the spirit and scope of the disclosed and claimed subject matter.

What is claimed is:

1. A thermal atomic layer etching process performed in a reactor for selectively etching a metal substrate comprising the steps of:

Step 1 comprising sequentially performing:

Step 1A comprising exposing a metal surface to an oxidizing vapor comprising one or more of water vapor, oxygen, ozone, nitrous oxide, nitric oxide, hydrogen peroxide, oxygen plasma, and combinations thereof, and Step 1B comprising purging the oxidizing vapor with an inert gas; and Step 2 comprising sequentially performing:

Step 2A comprising exposing the metal surface to one or more halogen-free organic acid volatizer, and Step 2B comprising purging the one or more halogen-free organic acid volatizer with an inert gas;

wherein one cycle of the process is determined by the formula $(\text{Step 1})_n+(\text{Step 2})_m$, wherein n and m are each independently=1-20, and wherein the Step 2A one or more halogen-free organic acid volatizer is heated to and held at from about 50° C. to about 100° C.

2. The process of claim 1, wherein the process comprises about 20 to about 2200 cycles.

3. The process of claim 1, wherein the process comprises selectively etching one or more of copper, cobalt, molybdenum and tungsten.

4. The process of claim 1, wherein the process comprises selectively etching copper preferentially instead of one or more of nickel, platinum, ruthenium, zirconium oxide and $SiO_2$.

5. The process of claim 1, wherein the process comprises selectively etching cobalt preferentially instead of one or more of nickel, platinum, ruthenium, zirconium oxide and $SiO_2$.

6. The process of claim 1, wherein the process comprises selectively etching molybdenum preferentially instead of one or more of nickel, platinum, ruthenium, zirconium oxide and $SiO_2$.

7. The process of claim 1, wherein the process comprises selectively etching tungsten preferentially instead of one or more of nickel, platinum, ruthenium, zirconium oxide and $SiO_2$.

8. The process of claim 1, wherein the reactor comprises an outer heater heated to a temperature of about 100° C. to about 300° C. and an inner heater heated to a temperature of about 100° C. to about 350° C.

9. The process of claim 1, wherein the Step 1A oxidizing vapor comprises one or more of water vapor, oxygen, ozone and hydrogen peroxide.

10. The process of claim 1, wherein the Step 1A oxidizing vapor comprises water vapor and one or more of oxygen and ozone.

11. The process of claim 1, wherein the Step 2A one or more halogen-free organic acid volatizer comprises one or more of propionic acid, isobutyric acid, pivalic acid, acetic acid, butanoic acid, acrylic acid, methacrylic acid, 2-methylbutanoic acid, 3-methylbutanoic acid, 3-butenoic acid, cyclopropanecarboxylic acid, pentanoic acid, (2E)-but-2-enoic acid, (Z)-2-butenoic acid and combinations thereof.

12. The process of claim 1, wherein the Step 2A one or more halogen-free organic acid volatizer comprises one or more of propionic acid, isobutyric acid, pivalic acid and combinations thereof.

13. The process of claim 1, wherein the Step 2A one or more halogen-free organic acid volatizer comprises propionic acid.

14. The process of claim 1, wherein the Step 2A one or more halogen-free organic acid volatizer comprises isobutyric acid.

15. The process of claim 1, wherein the Step 2A one or more halogen-free organic acid volatizer comprises pivalic acid.

16. The process of claim 1, wherein the Step 2A one or more halogen-free organic acid volatizer comprises two or more of propionic acid, isobutyric acid and pivalic acid.

17. A thermal atomic layer etching process performed in a reactor for selectively etching a metal substrate comprising the steps of:

Step 1 comprising sequentially performing:

Step 1A comprising exposing a metal surface to an oxidizing vapor comprising one or more of water vapor, oxygen, ozone, nitrous oxide, nitric oxide, hydrogen peroxide, oxygen plasma, and combinations thereof, and Step 1B comprising purging the oxidizing vapor with an inert gas; and Step 2 comprising sequentially performing:

Step 2A comprising exposing the metal surface to one or more halogen-free organic acid volatizer, and Step 2B comprising purging the one or more halogen-free organic acid volatizer with an inert gas;

wherein one cycle of the process is determined by the formula (Step 1) n+ (Step 2) m, wherein n and m are each independently=1-20 and wherein the Step 2A one or more halogen-free organic acid volatizer comprises one or more of propionic acid, isobutyric acid, pivalic acid and combinations thereof.

18. The process of claim 17, wherein the process comprises about 20 to about 2200 cycles.

19. The process of claim 17, wherein the process comprises selectively etching one or more of copper, cobalt, molybdenum and tungsten.

20. The process of claim 17, wherein the process comprises selectively etching copper preferentially instead of one or more of nickel, platinum, ruthenium, zirconium oxide and $SiO_2$.

21. The process of claim 17, wherein the process comprises selectively etching cobalt preferentially instead of one or more of nickel, platinum, ruthenium, zirconium oxide and $SiO_2$.

22. The process of claim 17, wherein the process comprises selectively etching molybdenum preferentially instead of one or more of nickel, platinum, ruthenium, zirconium oxide and $SiO_2$.

23. The process of claim 17, wherein the process comprises selectively etching tungsten preferentially instead of one or more of nickel, platinum, ruthenium, zirconium oxide and $SiO_2$.

24. The process of claim 17, wherein the reactor comprises an outer heater heated to a temperature of about 100° C. to about 300° C. and an inner heater heated to a temperature of about 100° C. to about 350° C.

25. The process of claim 17, wherein the Step 1A oxidizing vapor comprises one or more of water vapor, oxygen, ozone and hydrogen peroxide.

26. The process of claim 17, wherein the Step 1A oxidizing vapor comprises water vapor and one or more of oxygen and ozone.

27. The process of claim 17, wherein the Step 2A one or more halogen-free organic acid volatizer comprises propionic acid.

28. The process of claim 17, wherein the Step 2A one or more halogen-free organic acid volatizer comprises isobutyric acid.

29. The process of claim 17, wherein the Step 2A one or more halogen-free organic acid volatizer comprises pivalic acid.

30. The process of claim 17, wherein the Step 2A one or more halogen-free organic acid volatizer comprises two or more of propionic acid, isobutyric acid and pivalic acid.

31. The process of claim 17, wherein the Step 2A one or more halogen-free organic acid volatizer is heated to and held at from about 50° C. to about 100° C.

* * * * *